US007331650B2

(12) United States Patent
Hawkins et al.

(10) Patent No.: US 7,331,650 B2
(45) Date of Patent: Feb. 19, 2008

(54) PRINTHEAD HAVING A REMOVABLE NOZZLE PLATE

(75) Inventors: Gilbert A. Hawkins, Mendon, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 463 days.

(21) Appl. No.: 10/820,593

(22) Filed: Apr. 8, 2004

(65) Prior Publication Data

US 2005/0225597 A1 Oct. 13, 2005

(51) Int. Cl.
*B41J 2/135* (2006.01)

(52) U.S. Cl. ..... 347/44; 347/47; 347/49

(58) Field of Classification Search ..... 347/20, 347/44, 46, 47, 56, 61–65, 57, 49, 67, 22, 347/29

See application file for complete search history.

(56) References Cited

U.S. PATENT DOCUMENTS

| | | | | |
|---|---|---|---|---|
| 4,628,331 A | | 12/1986 | Ishikawa | 347/34 |
| 5,367,324 A | * | 11/1994 | Abe et al. | 347/62 |
| 5,563,641 A | * | 10/1996 | Plesinger | 347/47 |
| 5,684,519 A | * | 11/1997 | Matoba et al. | 347/54 |
| 5,726,693 A | * | 3/1998 | Sharma et al. | 347/48 |
| 5,900,892 A | | 5/1999 | Mantell et al. | 347/45 |
| 6,120,130 A | * | 9/2000 | Hirano et al. | 347/46 |
| 6,183,067 B1 | * | 2/2001 | Matta | 347/65 |
| 6,254,225 B1 | | 7/2001 | Chwalek et al. | 347/82 |
| 6,561,626 B1 | | 5/2003 | Min et al. | 347/47 |
| 6,582,060 B1 | | 6/2003 | Kitakami et al. | 347/56 |
| 6,598,960 B1 | | 7/2003 | Cabal et al. | 347/56 |
| 6,609,778 B2 | | 8/2003 | Ingham et al. | 347/20 |
| 6,631,979 B2 | | 10/2003 | Lebens et al. | 347/54 |
| 6,644,789 B1 | | 11/2003 | Toews, III | 347/63 |
| 6,817,698 B2 | * | 11/2004 | Verlinden et al. | 347/47 |
| 2002/0149649 A1 | * | 10/2002 | Moon et al. | 347/62 |
| 2003/0210299 A1 | * | 11/2003 | Min et al. | 347/47 |

FOREIGN PATENT DOCUMENTS

| | | |
|---|---|---|
| EP | 1110622 | 6/2001 |
| JP | 04214358 | 5/1992 |
| JP | 2002067311 | 5/2002 |

* cited by examiner

*Primary Examiner*—Juanita D. Stephens
(74) *Attorney, Agent, or Firm*—William R. Zimmerli

(57) ABSTRACT

A printhead and method of printing are provided. The printhead has a body with portions of the body defining a fluid chamber and a nozzle orifice. The nozzle orifice is in fluid communication with the fluid chamber. A drop forming mechanism is operatively associated with the nozzle orifice of the body. A plate is removably positioned over the body and has at least one orifice with the at least one orifice being in fluid communication with the nozzle orifice of the body.

44 Claims, 19 Drawing Sheets

PRINTHEAD HAVING A REMOVABLE NOZZLE PLATE

FIELD OF THE INVENTION

This invention relates generally to the field of digitally controlled printing devices, and in particular to the printhead portion of these devices.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized by technology, as either drop on demand ink jet or continuous ink jet.

The first technology, drop-on-demand ink jet printing, typically provides ink droplets for impact upon a recording surface using a pressurization actuator (thermal, piezoelectric, etc.). Selective activation of the actuator causes the formation and ejection of an ink droplet that crosses the space between the printhead and the print media and strikes the print media. The formation of printed images is achieved by controlling the individual formation of ink droplets, as is required to create the desired image. With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print medium.

A number of different nozzle arrangements are used with various types of printers described above. While, FIGS. 1*a*-1*d* show representative nozzle architectures for drop-on-demand printhead, the thermal and piezoelectric actuators described below, can also be found in nozzle architectures for continuous printheads.

FIG. 1*a* shows, in cross-sectional side view, the basic arrangement of an ejector 10 for one type of drop-on-demand ink jet printer, commonly termed a "roof-shooter device," and disclosed, for example, in U.S. Pat. No. 6,582,060 issued to Kitakami, et al. on Jun. 24, 2003. A bubble-jet heater provides a drop-forming mechanism 12 for ejecting ink from a nozzle orifice 14 of a fluid chamber 16 formed on a body 38 from a polymer material. The vapor bubble expands in the same direction as the direction of the ejected drop. With this arrangement, nozzle orifice 14 is part of a structure that is permanently bonded to a substrate 18 in the location of arrows 17.

FIG. 1*b* shows a schematic cross-sectional side view of an alternate ejector 10 arrangement in a drop-on-demand ink jet printer utilizing a thermal microactuator device, such as that disclosed in U.S. Pat. No. 6,631,979, issued to Lebens et al. on Oct. 14, 2003, and U.S. Pat. No. 6,598,960 issued to Cabal et al. on Jul. 29, 2003, as drop-forming mechanism 12 for ejecting ink from a nozzle orifice 14 of an fluid chamber 16. As with the FIG. 1*a* configuration, nozzle orifice 14 is permanently fixed in size and position as part of a structure bonded to substrate 18 in the location of arrows 17.

FIG. 1*c* shows a cross-sectional side view of another alternate ejector 10 arrangement in a drop-on-demand ink jet printer utilizing a piezoelectric actuator as drop-forming mechanism 12, and disclosed, for example, in U.S. Pat. No. 6,609,778 issued to Ingham, et al. on Aug. 26, 2003. Here, nozzle orifice 14 is provided by a nozzle plate 19 that is permanently bonded to fluid chamber 16 in the location of arrows 17.

FIG. 1*d* shows a cross-sectional side view of ejector 10 components in another type of drop-on-demand printer, commonly termed a "back-shooter device" type, and disclosed, for example, in U.S. Pat. No. 6,561,626, issued to Min et al. on May 13, 2003, using a thermal bubble-jet heater as drop-forming mechanism 12. The vapor bubble expands in a direction opposite the direction of the ejected drop. With this arrangement, nozzle plate 19, permanently bonded to substrate 18, forms part of the enclosing structure for fluid chamber 16 along with body 38 in the location of arrows 17.

In conventional continuous and drop-on-demand printhead design, nozzle plates are permanently bonded to the body of the printhead using various manufacturing techniques. For example, U.S. Pat. No. 6,644,789, issued to Toews, III on Nov. 11, 2003 discloses an arrangement using a photoresist layer having nozzle apertures laminated to another photoresist layer on the body of the printhead. U.S. Pat. No. 5,900,892 issued to Mantell et al. on May 4, 1999 discloses a nozzle plate fabricated using a photolithographic process, permanently bonded to the body of a printhead.

Additionally, and referring back to FIGS. 1*a*-1*d*, printheads are conventionally fabricated with a fixed diameter for nozzle orifice 14. The dimensions of nozzle orifice 14 are tailored to the viscosity and related drop-forming characteristics of a particular ink. While this arrangement may be expedient for many types of applications, this relatively inflexible dimensional constraint has some drawbacks. For example, by using a fixed diameter for nozzle orifice 14, a printing apparatus can be constrained to using only a narrow range of inks having a narrow range of viscosity or surface tension. Fixed nozzle orifice 14 dimensions also constrain possible droplet volumes to within a narrow range. Additionally, while it would be desirable to be able to vary the nozzle size of a given printhead instead of constructing a new printhead, no such technology has been commercialized.

Another disadvantage of conventional ejector 10 designs relates to cleaning. Numerous types of devices are employed for cleaning ink jet nozzles 10, both automatically and by hand. Using permanently bonded structures for nozzles 10 complicates the task of cleaning and refurbishing an ink jet printhead. A clogged nozzle plate, if bonded to the printhead using permanent adhesives such as epoxies, may render it economically impractical to clean the printhead, necessitating replacement of the complete printhead as a unit.

Thus, it can be appreciated that a more flexible ink jet nozzle plate design could provide substantial benefits for ease of use, equipment maintenance, and overall versatility of a printing apparatus.

SUMMARY OF THE INVENTION

According to one aspect of the present invention, a printhead includes a body with portions of the body defining an fluid chamber and a nozzle orifice. The nozzle orifice is in fluid communication with the fluid chamber. A drop forming mechanism is operatively associated with the nozzle orifice of the body. A plate is removably positioned over the body. The plate has at least one orifice in fluid communication with the nozzle orifice of the body.

According to another aspect of the present invention, a method of printing includes ejecting fluid drops through a body nozzle orifice and then through a plate nozzle orifice, the plate nozzle orifice being in fluid communication with the body nozzle orifice; removing the plate; replacing the plate with a second plate having a nozzle orifice; and ejecting fluid drops through the body nozzle orifice and then through the second plate nozzle orifice, the second plate nozzle orifice being in fluid communication with the body nozzle orifice.

According to another aspect of the present invention, a method of printing includes ejecting fluid drops through a body nozzle orifice and then through a plate nozzle orifice of a plate, the plate nozzle orifice being in fluid communication with the body nozzle orifice; manipulating the plate; repositioning the plate; and ejecting fluid drops through the body nozzle orifice and then through the plate nozzle orifice, the plate nozzle orifice being in fluid communication with the body nozzle orifice.

According to another aspect of the present invention, a printhead includes a body with portions of the body defining an fluid chamber. A drop forming mechanism is operatively associated with the fluid chamber. A removable plate has a first position over the body and a second position removed from the body. The plate has at least plate one orifice with the at least one plate orifice being in fluid communication with the fluid chamber of the body when the plate is located in the first position over the body.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
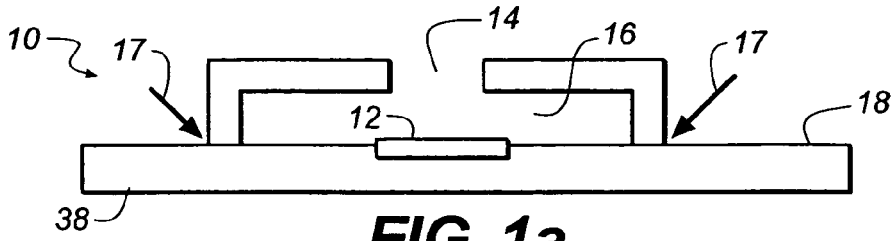
FIG. 1a (PRIOR ART)
FIGS. 1*a*, 1*b*, 1*c*, and 1*d* are cross-sectional side views showing various prior art arrangements of printheads with associated droplet formation components.
Figure 1B:
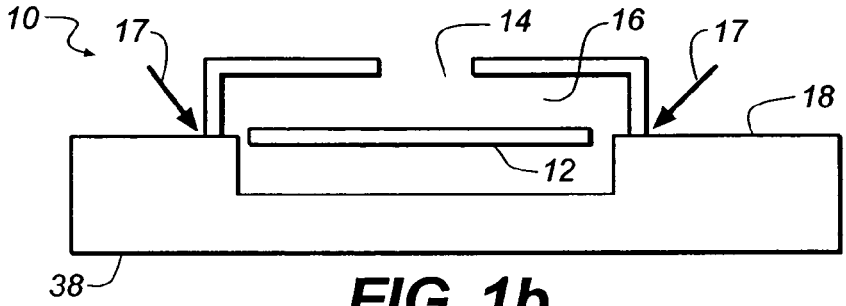
FIG. 1b (PRIOR ART)
Figure 1C:
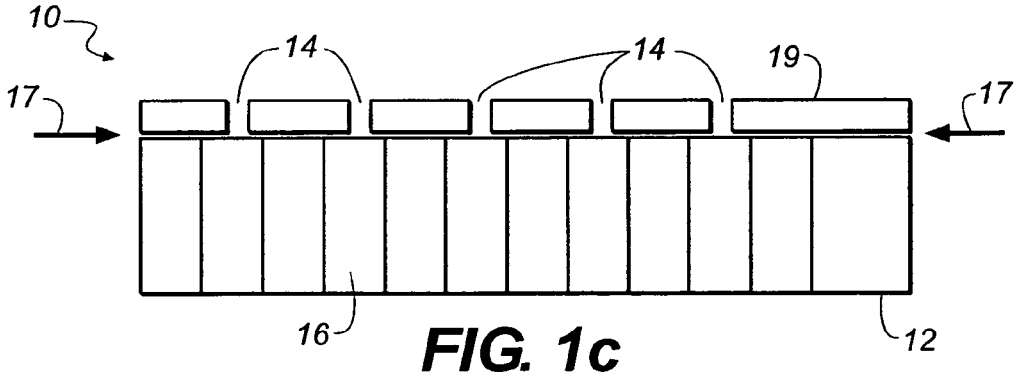
FIG. 1c (PRIOR ART)
Figure 1D:
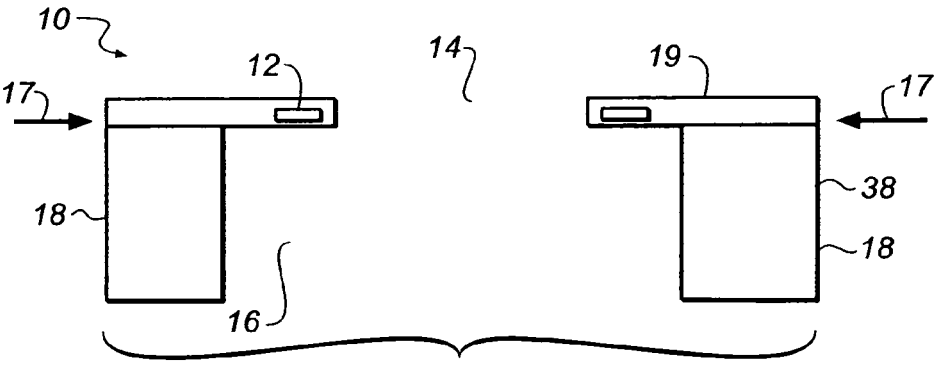
FIG. 1d (PRIOR ART)
Figure 2A:
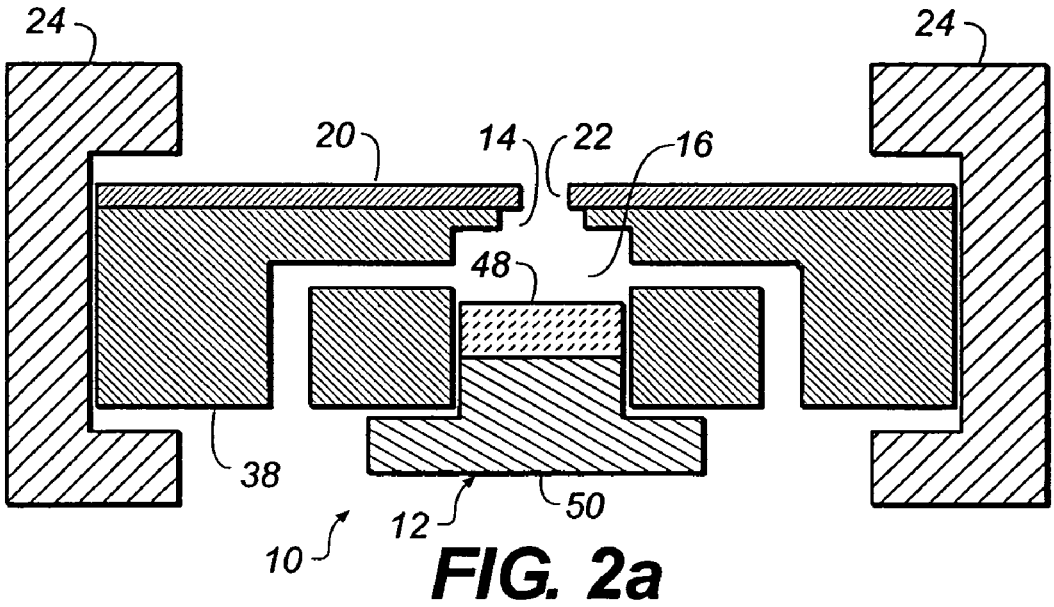
FIGS. 2*a* and 2*b* are cross-sectional side views showing a drop-on-demand ink jet nozzle using a piezoelectric actuator, adapted with a removable nozzle plate according to the present invention, showing component arrangement and operation, respectively.
Figure 2B:
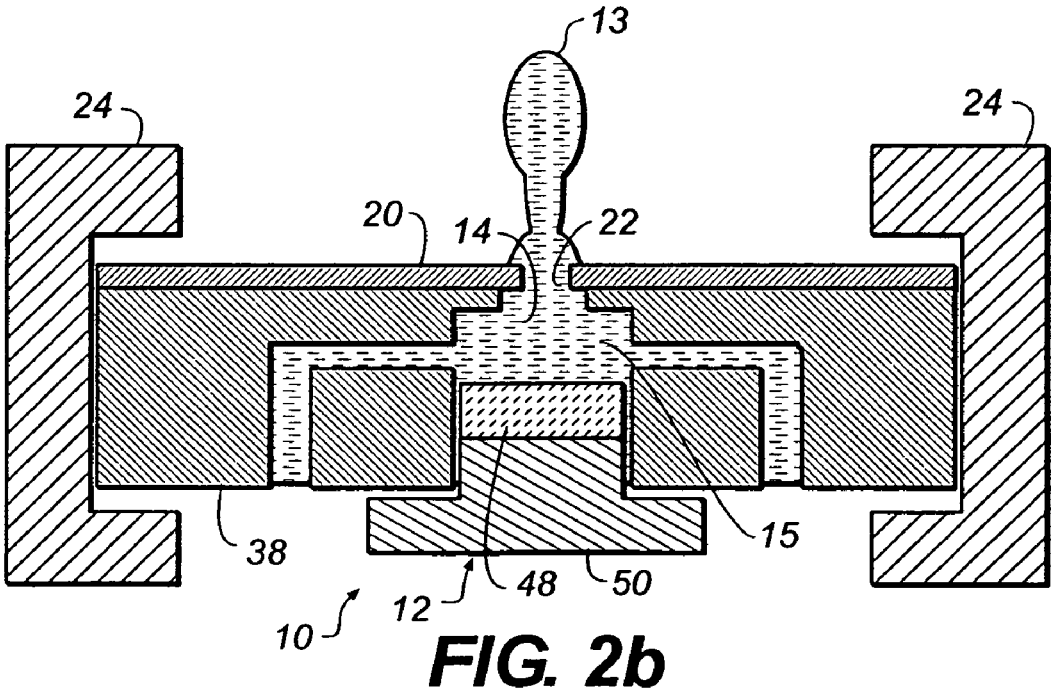

FIGS. 2*a* and 2*b* show cross-sectional side views of ejector 10 in accordance with one embodiment of the present invention. In FIG. 2*a*, within body 38, a piezoelectric actuator having a piezoelectric crystal 48 on a piezoelectric mount 50 serves as drop-forming mechanism 12 for ejecting ink droplets from nozzle orifice 14 of fluid chamber 16. FIG. 2*a* depicts the structure of ejector 10, particularly showing a removable nozzle plate 20 and a plate orifice 22 of removable nozzle plate 20 as well as a clamping mechanism 24 which holds removable nozzle plate 20 to body 38 of ejector 10, while FIG. 2*b* depicts the ejection of a fluid 15 from fluid chamber 16, particularly showing fluid 15 as it is ejected through plate orifice 22.

Fluid 15 is ejected through plate orifice 22 in a manner similar to the way fluid 15 would be ejected through nozzle orifice 14 in the absence of removable plate 20, as discussed later, in the sense that piezoelectric crystal 48 generates a pressure pulse within fluid chamber 16 which forces fluid 15 out of plate orifice 22, subsequently resulting in formation of a fluid droplet 13, as is well known in the art of inkjet printing. Plate orifice 22 is preferably smaller than nozzle orifice 14 and hence the ejected fluid droplets 13 of the present invention are preferably somewhat smaller than droplets 13 which would be ejected through nozzle orifice 14 in the absence of removable plate 20. Typically, although not necessarily, nozzle orifice 14 is smaller in diameter than fluid chamber 16. Plate orifice 22 is usually centered within nozzle orifice 14, although this is not required in every application. Typically, although not necessarily, plate orifice 22 and nozzle orifice 14 are round.

Figure 3A:
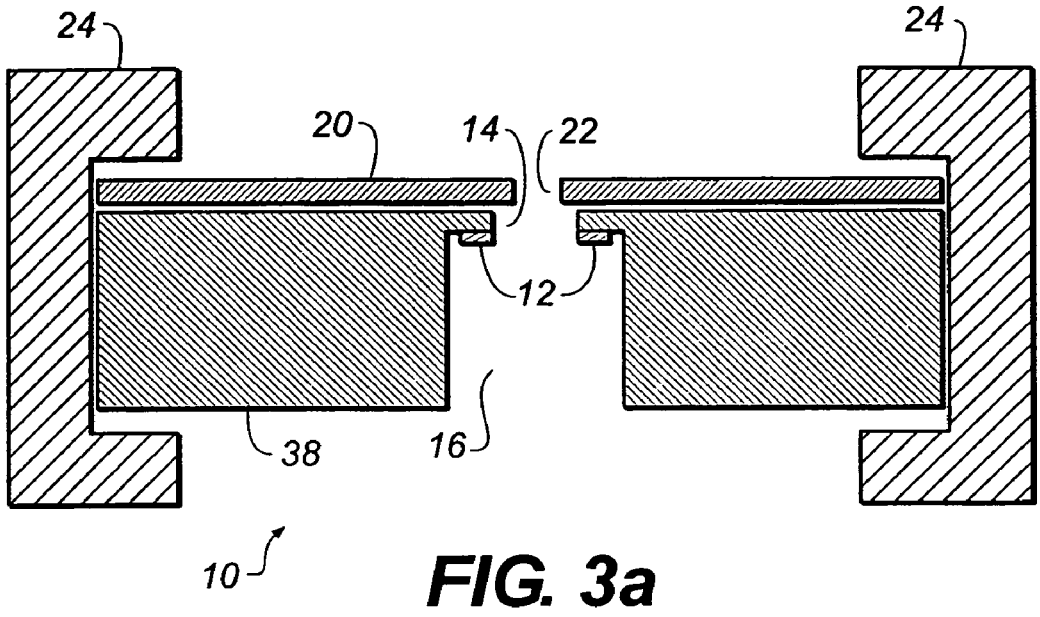
FIGS. 3*a* and 3*b* are cross-sectional side views showing a drop-on-demand ink jet nozzle of the thermal backshooter type using a heater for droplet formation, adapted with a removable nozzle plate according to the present invention, showing component arrangement and operation, respectively.
Figure 3B:
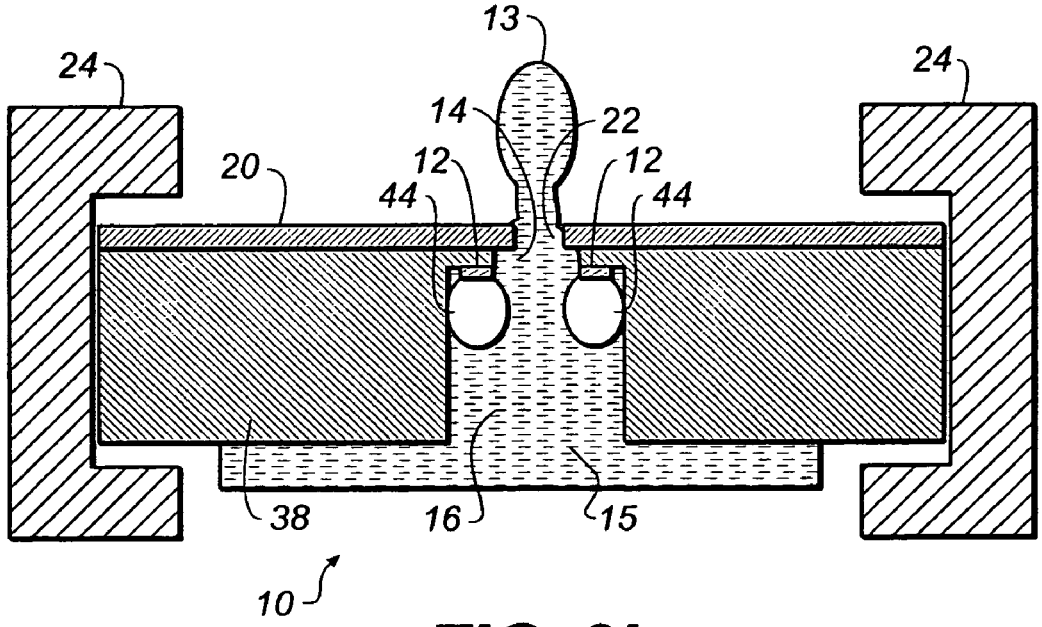

Referring to FIGS. 3*a* and 3*b*, there is shown schematically a second embodiment of ejector 10 according to the present invention. Here, a drop-on-demand ink jet printhead of the thermal backshooter device type, disclosed, for example, in U.S. Pat. No. 6,561,626 is adapted with a removable nozzle plate 20, held in place against body 38 by clamping mechanism 24. Plate orifice 22 in nozzle plate 20 is held in place over nozzle orifice 14 of the printhead. Removal of removable nozzle plate 20 and of clamping mechanism 24 is possible, in which case fluid 15 would then be ejected from nozzle orifice 14 as in U.S. Pat. No. 6,561,626. FIG. 3*a* depicts the structure of ejector 10, particularly showing removable nozzle plate 20 and plate orifice 22 of removable nozzle plate 20, while FIG. 3*b* depicts the ejection of fluid 15 from fluid chamber 16, particularly showing fluid 15 as it is ejected through plate orifice 22.

Fluid 15 is ejected through plate orifice 22 to form fluid droplet 13 in a manner similar to the way fluid 15 would be ejected through nozzle orifice 14 in the absence of removable plate 20, as discussed later, in the sense that the bubble formed by the thermal backshooter shown in FIG. 3*b* forces fluid 15 out of plate orifice 22, subsequently resulting in formation of fluid droplet 13, as is well known in the art of inkjet printing. Plate orifice 22 is preferably smaller than nozzle orifice 14 and hence ejected fluid droplets 13 of the present invention are preferably somewhat smaller than fluid droplets 13 which would be ejected through nozzle orifice 14 in the absence of removable plate 20. Typically, although not necessarily, the diameter of nozzle orifice 14 is smaller than fluid chamber 16. Plate orifice 22 is usually centered within nozzle orifice 14, although this is not required in every application. Typically, although not necessarily, plate orifice 22 and nozzle orifice 14 are round. As described in more detail below, using plate orifice 22, the dimensions of the ejecting orifice can be changed, affecting the dimensions of ejected fluid droplet 13.

Figure 4A:
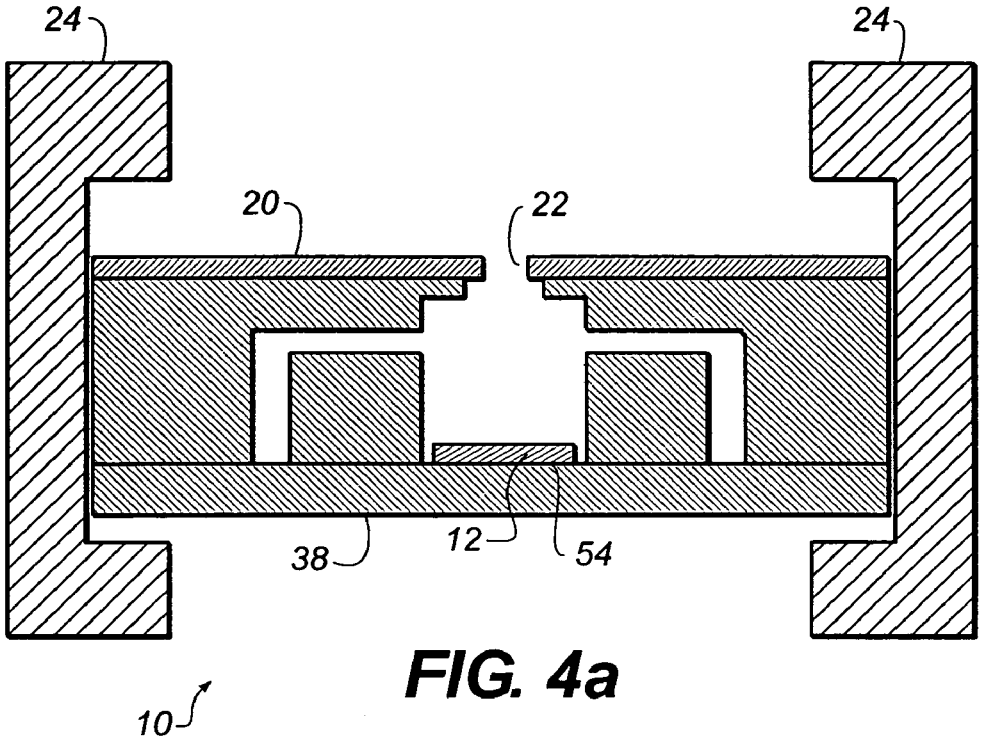
FIGS. 4*a* and 4*b* are cross-sectional side views showing a drop-on-demand ink jet nozzle of the thermal roofshooter type using a heater for droplet formation, adapted with a removable nozzle plate according to the present invention, showing component arrangement and operation, respectively.
Figure 4B:
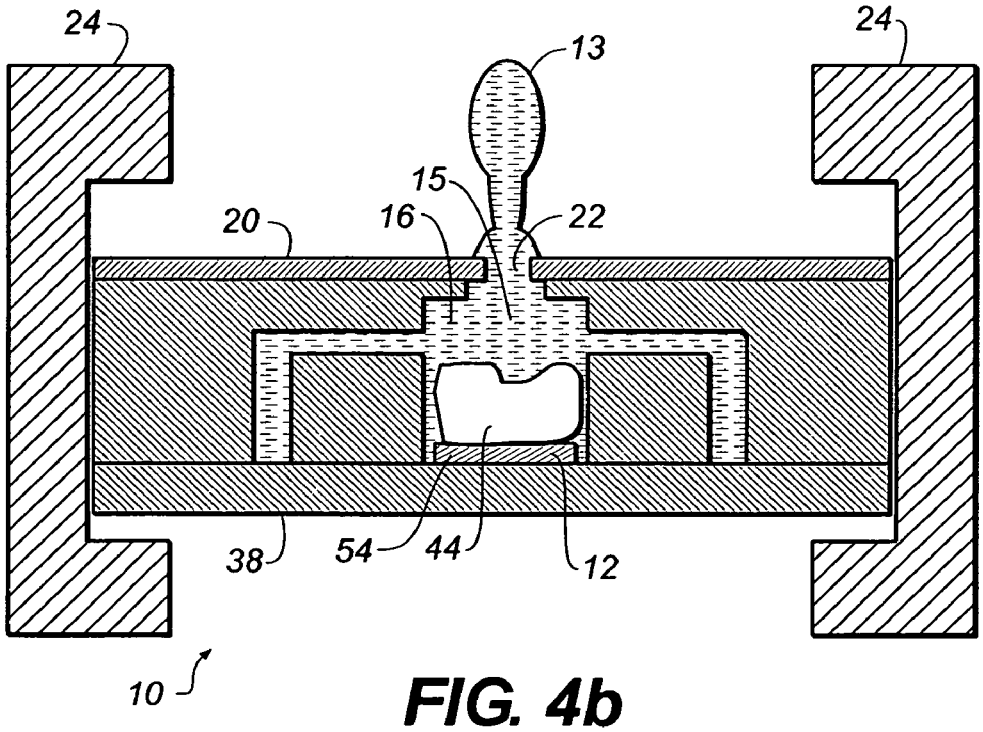

Referring to FIGS. 4*a* and 4*b*, there is shown another embodiment of the present invention, applied to a thermal roof-shooter device drop-on-demand printhead using a heater element 54 as drop forming mechanism 12, as disclosed, for example, in U.S. Pat. No. 6,582,060. Again, removable nozzle plate 20, held in place by clamping mechanism 24, positions plate orifice 22 over nozzle orifice 14. As FIG. 4*b* shows, a heat-generated bubble 44 or other disturbance is generated to eject the ink stream from plate orifice 22. Removal of removable nozzle plate 20 and of clamping mechanism 24 is possible, in which case ink would then be ejected from nozzle orifice 14 as in U.S. Pat. No. 6,582,060. FIG. 4*a* depicts the structure of ejector 10, particularly showing removable nozzle plate 20 and plate orifice 22 of removable nozzle plate 20, while FIG. 4*b* depicts the ejection of fluid 15 from fluid chamber 16, particularly showing fluid 15 as it is ejected through plate orifice 22.

Fluid 15 is ejected through plate orifice 22 in a manner similar to the way fluid 15 would be ejected through nozzle orifice 14 in the absence of removable plate 20, as discussed later, in the sense that the bubble formed by the thermal roof-shooter shown in FIG. 4*b* forces fluid out plate orifice 22, subsequently resulting in formation of fluid droplet 13, as is well known in the art of inkjet printing. Plate orifice 22 is preferably smaller than nozzle orifice 14 and hence ejected droplets 13 of the present invention are preferably somewhat smaller than droplets 13 which would be ejected through nozzle orifice 14 in the absence of removable plate 20. Preferably, although not necessarily, nozzle orifice 14 is smaller in diameter than fluid chamber 16. Typically, although not necessarily, plate orifice 22 is centered within nozzle orifice 14. Usually, although not necessarily, plate orifice 22 and nozzle orifice 14 are round. As described in more detail below, using plate orifice 22, the dimensions of the ejecting orifice could be changed, affecting the dimensions of ejected fluid droplet 13.

Figure 5A:
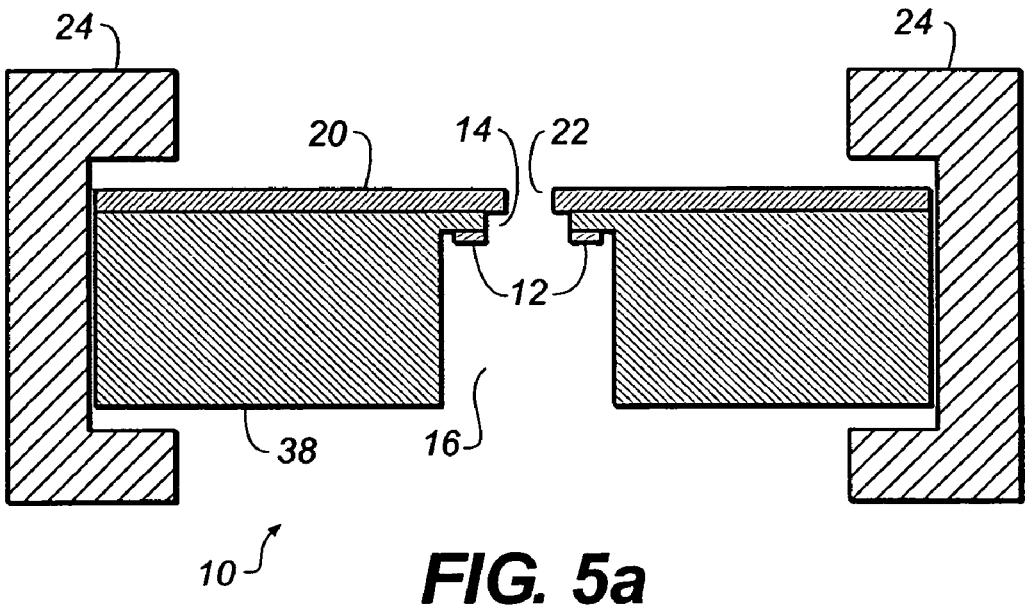
FIGS. 5*a* and 5*b* are cross-sectional side views showing a continuous ink jet nozzle using a heater for droplet formation, adapted with a removable nozzle plate according to the present invention, showing component arrangement and operation, respectively.
Figure 5B:
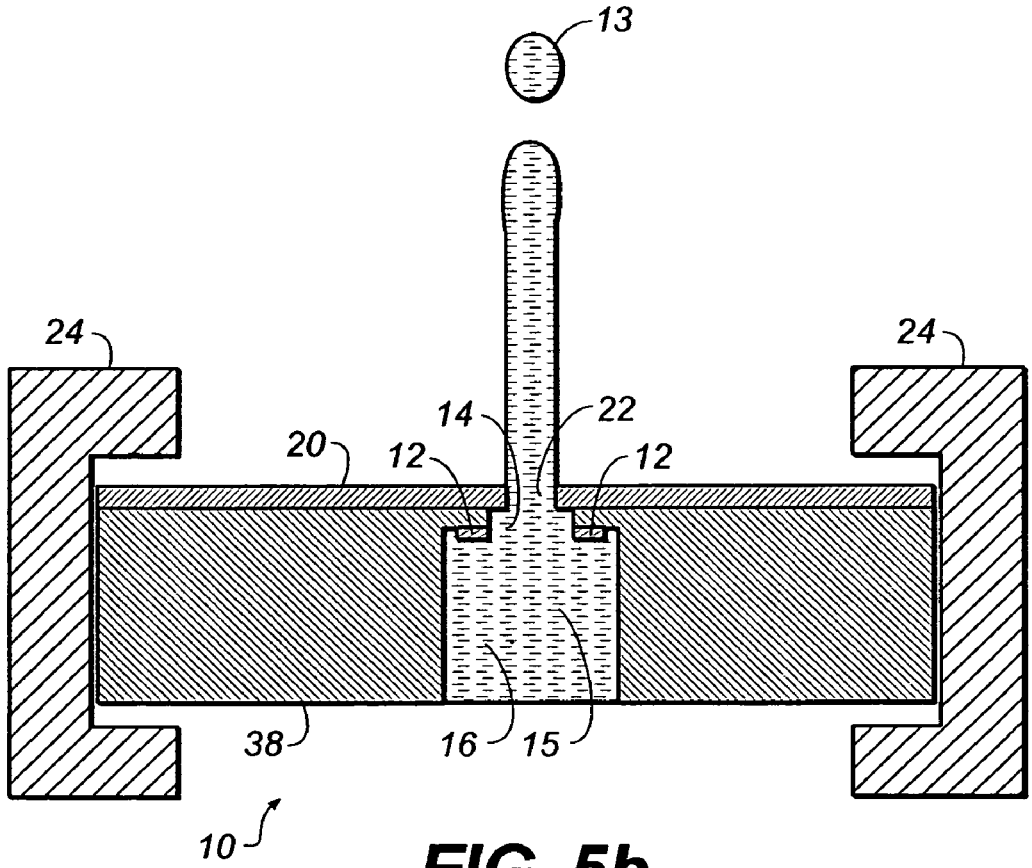
Figure 6A:
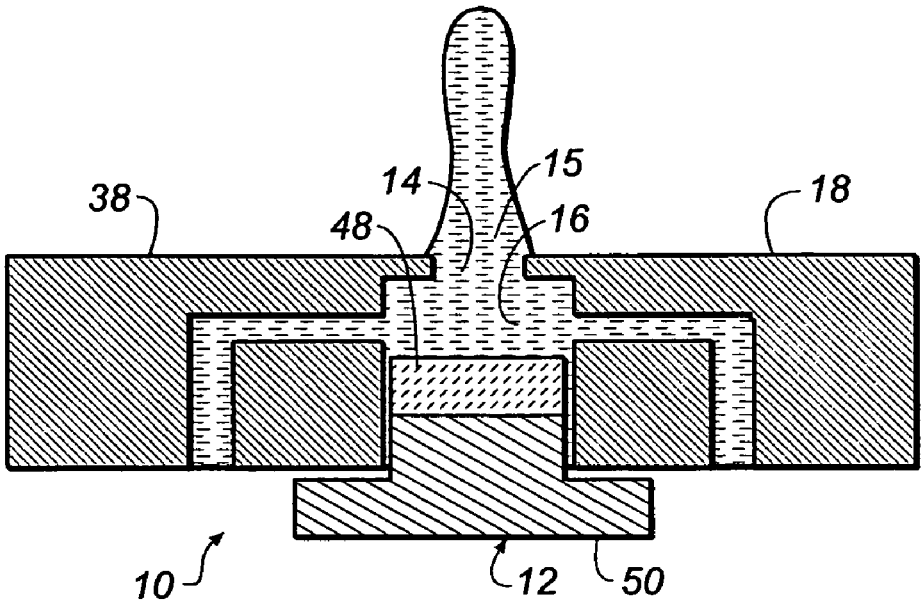
FIG. 6*a*-6*d* are cross-sectional side views showing the inkjet nozzles of FIGS. 2*a* and 2*b*, 3*a* and 3*b*, 4*a* and 4*b*, and 5*a* and 5*b* respectively, having the removable nozzle plate removed to a second position.
Figure 6B:
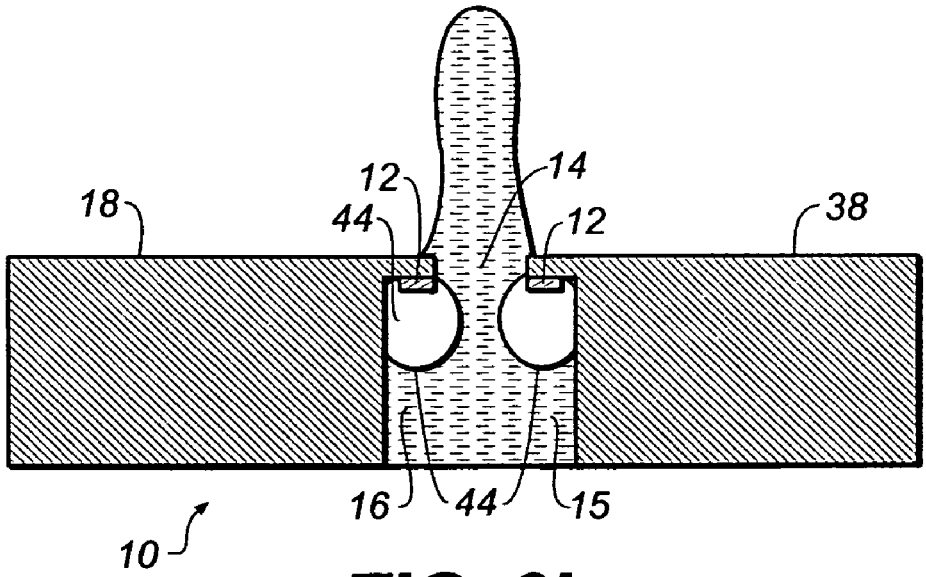
Figure 6C:
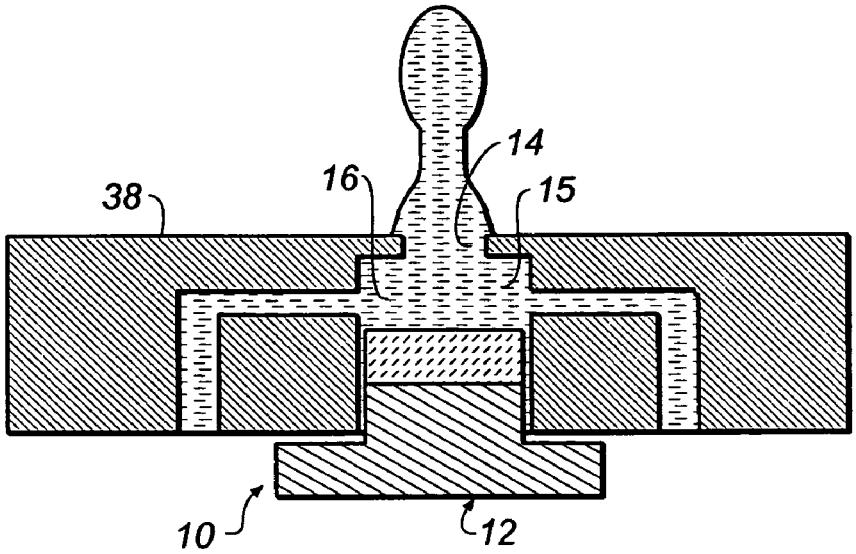
Figure 6D:
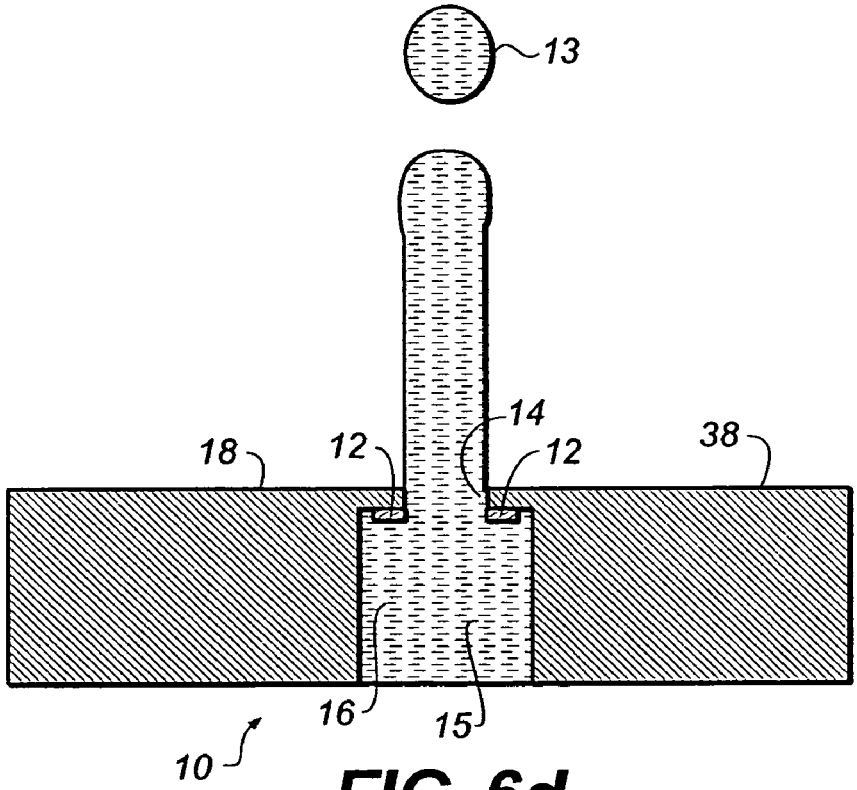

Referring to FIGS. 5*a* and 5*b*, there is shown another embodiment of the present invention, applied to a continuous inkjet ejector 10 whose drop formation means is thermal, as disclosed, for example, in U.S. Pat. No. 6,254,225. Again, removable nozzle plate 20, held in place by clamping mechanism 24, positions plate orifice 22 over nozzle orifice 14. As FIG. 5*b* shows, activation of a heater causes the ejected stream from plate orifice 22 to break up into discrete fluid droplets 13.

FIG. 5*a* depicts the structure of ejector 10, particularly showing removable nozzle plate 20 and plate orifice 22 of removable nozzle plate 20, while FIG. 5*b* depicts the ejection of fluid 15 from fluid chamber 16, particularly showing fluid 15 as it is ejected through plate orifice 22.

Fluid 15 is ejected through plate orifice 22 in a manner similar to the way fluid 15 would be ejected through nozzle orifice 14 in the absence of removable plate 20, as discussed later, in the sense that fluid droplets 13 are formed by the continuous inkjet droplet ejector in accordance with the teachings of U.S. Pat. No. 6,254,225. Plate orifice 22 is preferably smaller in diameter than nozzle orifice 14 and hence ejected fluid droplets 13 of the present invention are preferably somewhat smaller than droplets 13 which would be ejected through nozzle orifice 14 in the absence of removable plate 20. Typically, although not necessarily, nozzle orifice 14 is smaller in diameter than fluid chamber 16. Typically, although not necessarily, plate orifice 22 is centered within nozzle orifice 14. Usually, although not necessarily, plate orifice 22 and nozzle orifice 14 are round. As described in more detail below, using plate orifice 22, the dimensions of the ejecting orifice could be changed, affecting the dimensions of the ejected ink stream and of fluid droplets 13 formed therefrom.

Referring to FIGS. 6*a*-6*d*, corresponding, respectively, to FIGS. 2*b*, 3*b*, 4*b*, and 5*b*, ejectors 10 are shown having their respective removable nozzle plates 20 in a removed or second position, and preferably ejecting fluid 15 in a manner similar to the way fluid 15 would be ejected in prior art devices, although the ejection efficiency of such devices having their respective removable nozzle plates 20 in a removed or second position would not necessarily be optimal. As would be appreciated by one skilled in the art of inkjet ejector design, if the diameter of nozzle orifice 19 is close to or greater than that of fluid chamber 16, droplet 13 ejection might not be possible at all when removable nozzle plate 20 is in a removed or second position.

Arrangement and Clamping of Nozzle Plate 20

Figure 7:
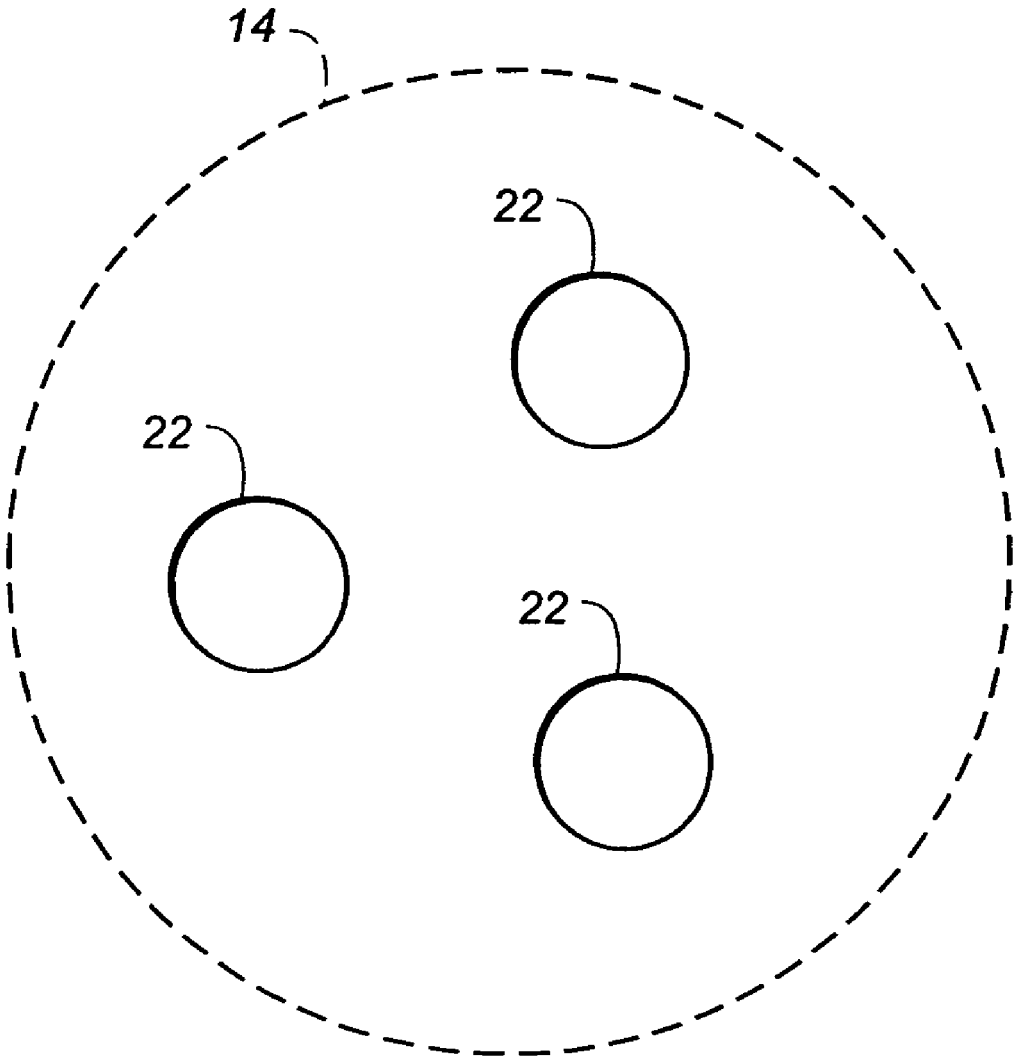
FIG. 7 shows a top view of one arrangement wherein multiple smaller plate orifices are provided for a single nozzle orifice.

Referring to FIG. 7, there is shown a top view of a single ejector 10 of removable nozzle plate 20 in an alternate embodiment. Here, there are multiple plate orifices 22 for a single nozzle orifice 14. This enables ink ejection from multiple ports, which may have advantages for fluid droplet 13 formation in some applications. Contrast this top view with the top view of FIG. 8*a*, in which a single plate orifice 22 is centered over each nozzle orifice 14. Although the plate orifices in FIGS. 7 and 8*a*-8*g* are shown round, other shapes are possible, for example triangular or rectangular shapes, which may be beneficial in controlling droplet 13 trajectories and improving fluid droplet 13 ejection efficiency.

Figure 8A:
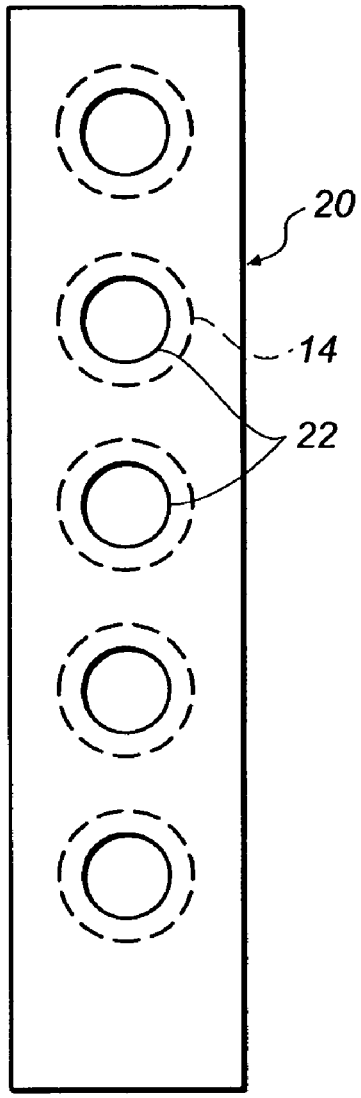
FIGS. 8*a*, 8*b*, and 8*c* show top views of a removable nozzle plate of the present invention, in various clamping arrangements.

Referring to FIGS. 8*a*, 8*b*, 8*c*, and 8*d*, there are shown a few of the many possible embodiments of removable nozzle plate 20 and clamping mechanism 24. In the embodiment of FIG. 8*a*, removable nozzle plate 20 is affixed to body 38 of the printhead using a removable or reusable bonding agent or adhesive. This is to be distinguished from the use of a permanent bonding agent, such as epoxy or similar adhesive substance. For removability, only a small force should be required for peeling removable nozzle plate 20 from base 38. As a guideline, this removal force, or peeling force, should not exceed about 100 g/cm applied to an edge of removable nozzle plate 20 in a direction perpendicular to the plane of removable nozzle plate 20.

A reusable bonding agent or adhesive retains nozzle plate 20 in place with sufficient strength for printing, but allows disassembly of a printhead for cleaning, for indexing of removable nozzle plate 20 to some other position, for replacement of removable nozzle plate 20, etc. Reusable bonding agents can include any of a number of types of adhesives, including paraffin or a suitable adhesive wax. Wax substances are particularly advantaged due to their hydrophobic properties. Use of a wax substance allows heat to be used for removal of nozzle plate 20. However, the melting temperature of the wax substance should be higher than the temperature experienced by the printhead during operation. The wax substance can be vacuum-deposited or applied as a melt or a liquid in a solvent.

Figure 8B:
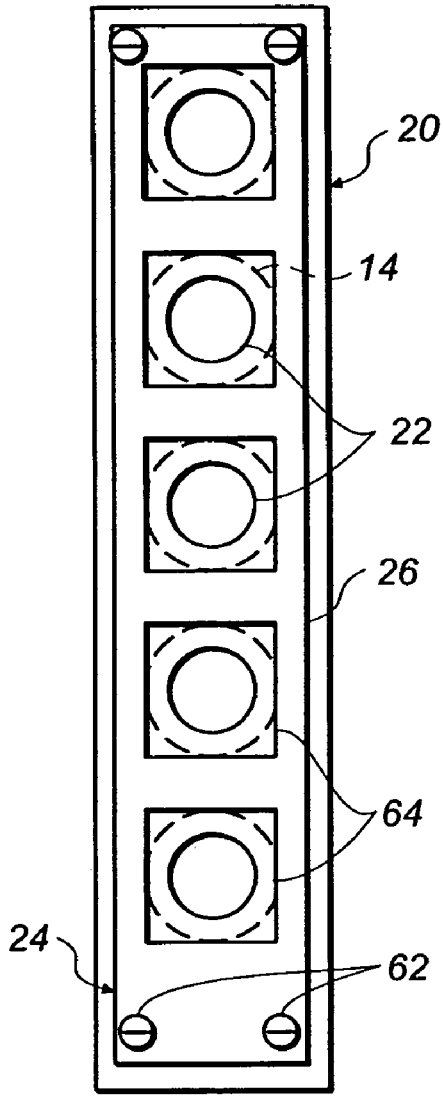

In the embodiment of FIG. 8*b*, clamping mechanism 24 in the form of a sheet clamp 26 is provided for retaining removable nozzle plate 20 in place against body 38, using an arrangement of fasteners 62 such as screws or other free or captive mechanisms, for example. Such a sheet clamp 26 could be fabricated from a thin, stiff membrane made, for example, by semiconductor fabrication techniques well known in the art of Micro Electromechanical Systems (MEMS) fabrication.

Figure 8C:
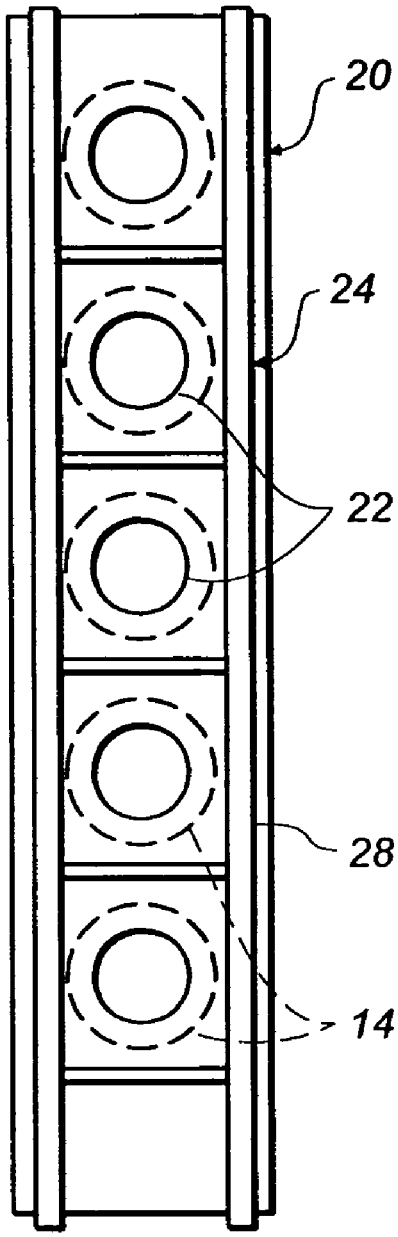
Figure 8D:
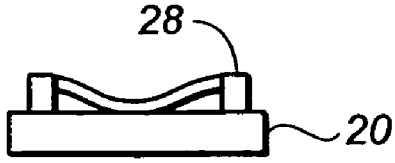
FIG. 8*d* shows a side view of the clamping arrangement of FIG. 8*c;*

In the embodiment shown in the top view of FIG. 8*c* and in its corresponding side view in FIG. 8*d*, a wire clamp 28 is employed as clamping mechanism 24 for retaining removable nozzle plate 20, preferably applying some amount of spring force for maintaining good contact and stable positioning. In one embodiment, electro-formed nickel is used to provide wire clamp 28 having a spring force, made, for example, by MEMS fabrication methods.

Figure 8E:
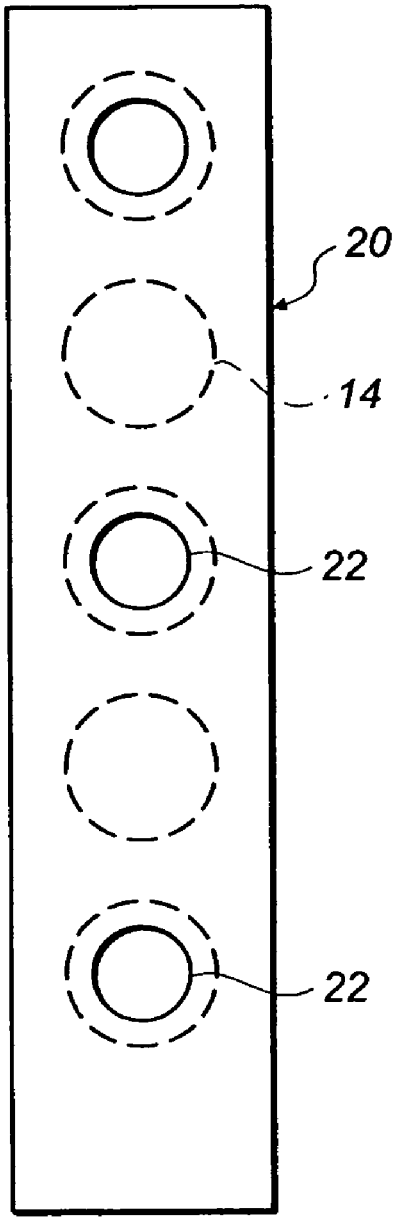
FIGS. 8*e*, 8*f*, and 8*g* show top views of a removable nozzle plate of the present invention having various arrangements of plate orifices.
Figure 8F:
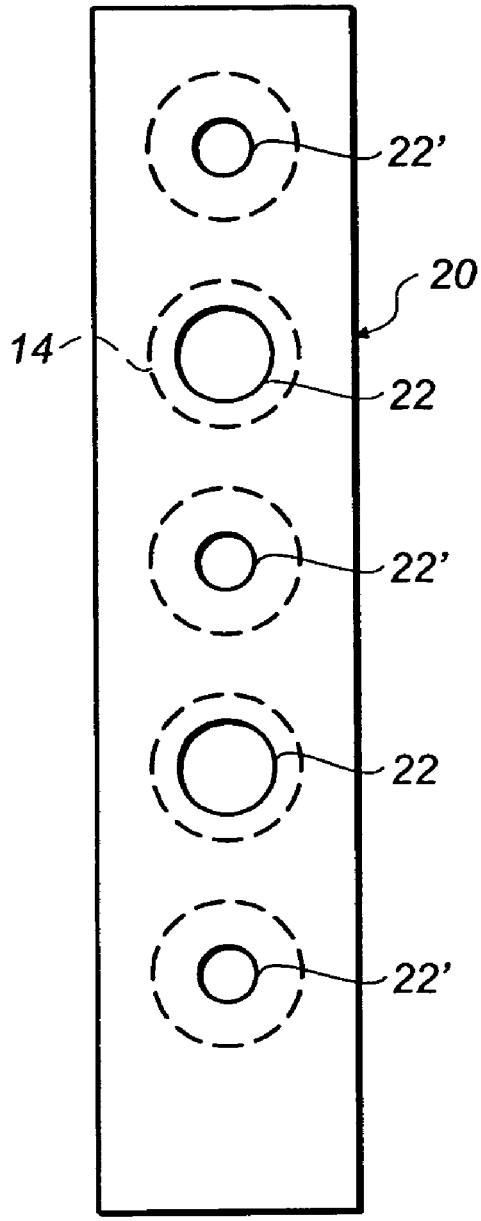
Figure 8G:
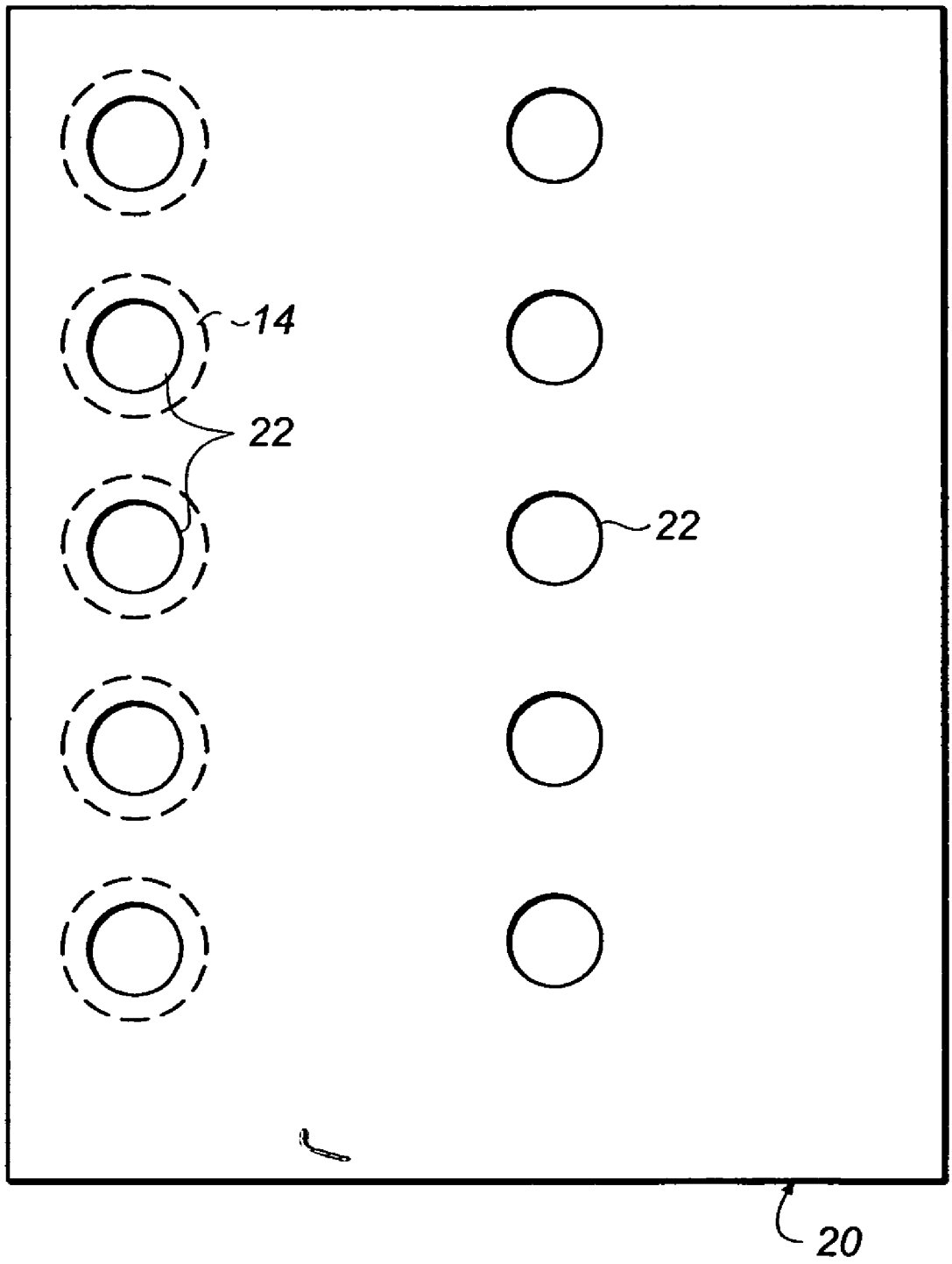

Referring to FIG. 8*e*-8*g*, other configurations of plate orifices 22 are useful in accordance with the present invention. For example, FIG. 8*e* shows the case in which not all nozzle orifices 14 are associated with a plate orifice 22, in other words some plate orifices 22 have been omitted. Since no fluid droplets 13 are ejected in the absence of a plate orifice 22, this embodiment allows for a controlled reduction in the density of fluid droplet 13 ejectors. In FIG. 8*f*, plate orifices 22 and 22' having different sizes are interspersed on an array of nozzle orifices 14, which allows for multiple sizes of ejected fluid droplets 13.

In yet another embodiment, shown in FIG. 8*g*, plate orifices 22 are shown located in more than one array. In this case, removable nozzle plate 20 can be positioned or indexed, for example by sliding or by removal and repositioning, so that a different group of plate orifices 22 are positioned over nozzle orifices 14, so as to provide a redundancy of plate nozzles, for example, should a portion of those initially positioned over nozzle orifices 14 be damaged.

It is also contemplated, although not shown, that certain nozzle orifices could 14 be omitted, so that the number of plate orifices 22 is larger than the number of nozzle orifices 14. For example, every other nozzle orifice 14 might be omitted in FIG. 8*a*, for example. Again, in this case, removable nozzle plate 20 can be positioned, for example by sliding or by removal and repositioning, so that a different group of plate orifices 22 is positioned over nozzle orifices 14, so as to provide a redundancy of plate orifices 22 should a portion of those initially positioned over nozzle orifices 14 be damaged.

Figure 9:
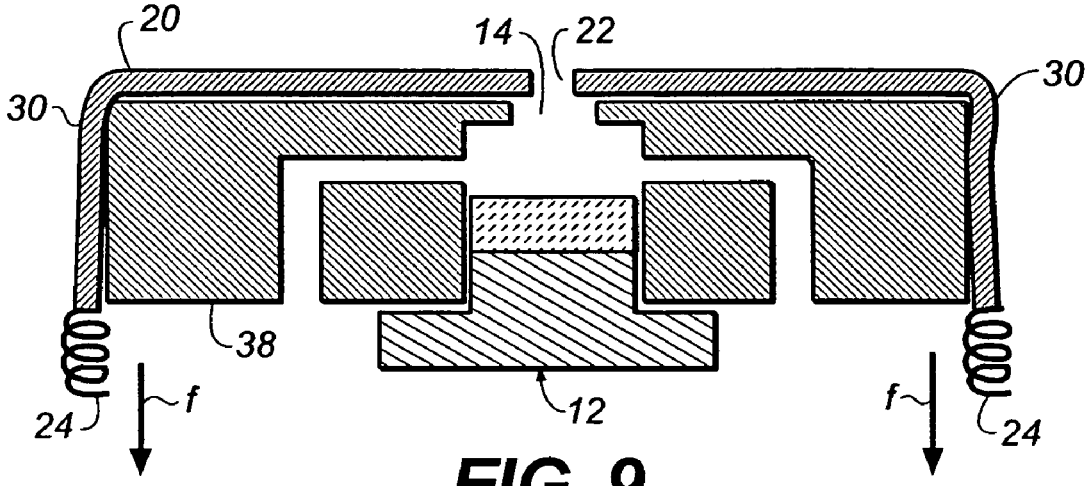
FIG. 9 is a cross-sectional side view showing an ink jet nozzle outfitted with the nozzle plate of the present invention, retained by a spring clamping mechanism.

Referring to FIG. 9, there is shown another mechanism for retaining removable nozzle plate 20 against body 38. Here, removable nozzle plate 20 is formed from a flexible material that allows it, over a flexible portion 30, to be bent around edges of body 38 and to be held in place by a clamping force f from a spring and a spring clamp mechanism of some type (as represented by clamping mechanism 24 in FIG. 9). Retaining force f can be provided by others sources. For example, a retaining force f can be applied by a solenoid activated electrically.

Figure 12A:
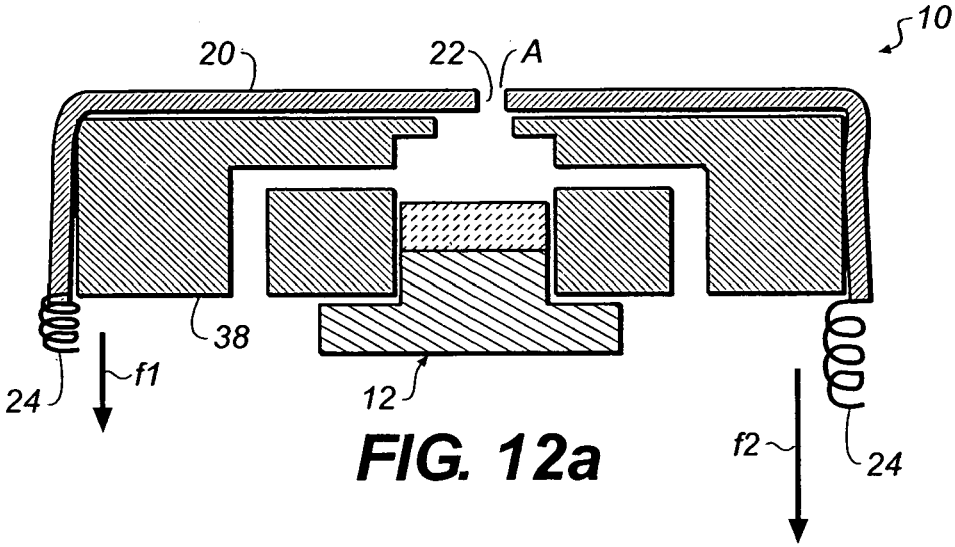
FIGS. 12*a* and 12*b* are cross-sectional side views showing an ink jet nozzle outfitted with the nozzle plate of the present invention, wherein the position of the nozzle plate orifice can be adjusted by adjusting the clamping mechanism.
Figure 12B:
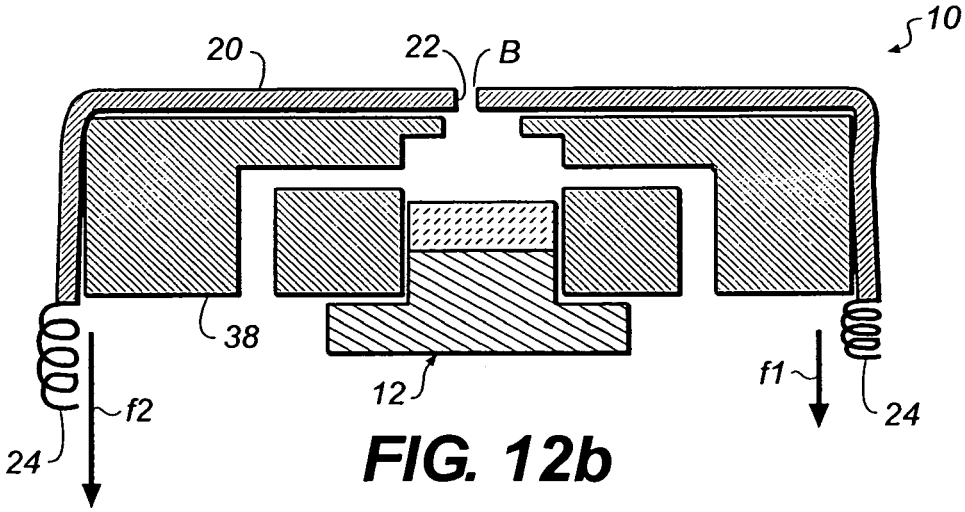

Referring to FIGS. 12*a* and 12*b*, it can be observed that, by making removable nozzle plate 20 of some flexible material and by varying the retaining force f1, f2 applied, plate nozzle 22 can be shifted from a position A (shown in FIG. 12*a*) to a slightly different position B (shown in FIG. 12*b*). This arrangement allows adjustment of plate nozzle 22 position for some portion of the printhead or for the complete printhead. By proper selection of materials and positioning of clamping mechanism 24 components, individual plate nozzle 22 positioning can be performed. This allows, for example, nozzle-to-nozzle correction, can be useful for compensating for performance or mechanical tolerance variations across the printhead, providing nozzle plate 20 were an elastic material such as silicone or poly dimethyl silane (PDMS).

Figure 10:
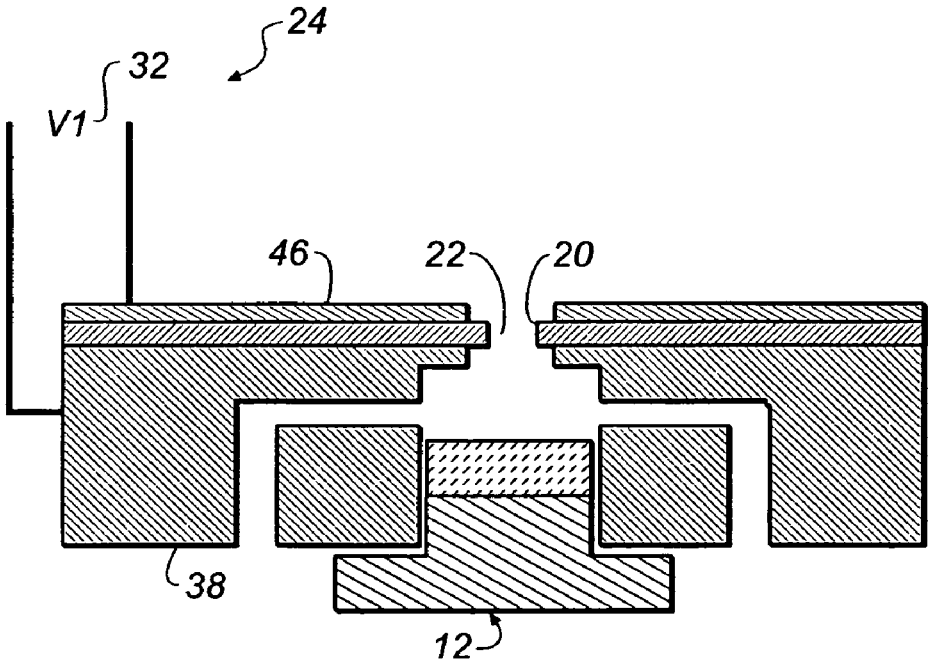
FIG. 10 is a cross-sectional side view showing an ink jet nozzle outfitted with the nozzle plate of the present invention, retained by an applied electromagnetic force.

Referring to FIG. 10, an electrostatic clamping mechanism 32 is shown for retaining removable nozzle plate 20 in place. In this embodiment, a voltage V1 is applied between a metallized plate 46 and body 38, thereby clamping removable nozzle plate 20 in place. For the embodiment of FIG. 10, removable nozzle plate 20 is a non-conductive material. Metallized plate 46 can be an aluminum-coated mylar plate, for example, and voltage V1 can be in the range of several tens to hundreds of volts. Magnetic or electromagnetic retaining mechanisms can similarly be employed if removable nozzle plate 20 or clamping sheet 26 is made of magnetic material which can be attracted toward body 38 by magnetic forces, either from body 38 itself or associated permanent or electromagnets (not shown), as can be appreciated by one skilled in electromechanical design.

Figure 11:
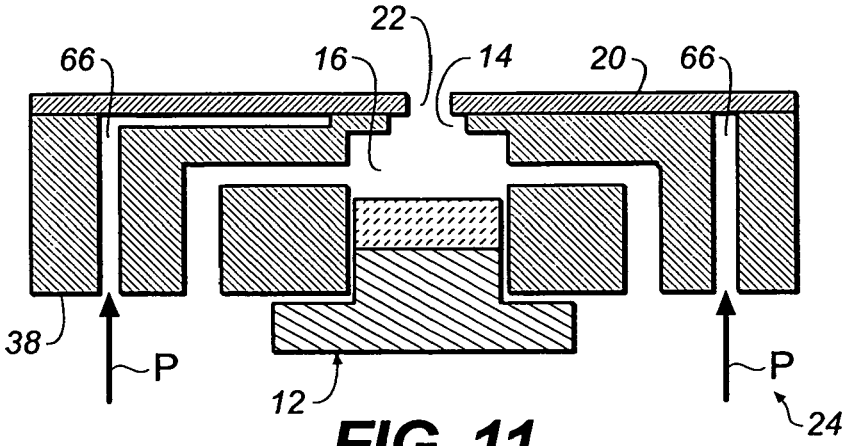
FIG. 11 is a cross-sectional side view showing an ink jet nozzle outfitted with the nozzle plate of the present invention, retained by applied pressure or vacuum.

Another method for retaining removable nozzle plate 20 on body 38 is using vacuum pressure, as is shown in the cross-sectional view of FIG. 11. Negative vacuum pressure P is applied through passages 66 to hold removable nozzle plate 20 securely in place.

Figure 13:
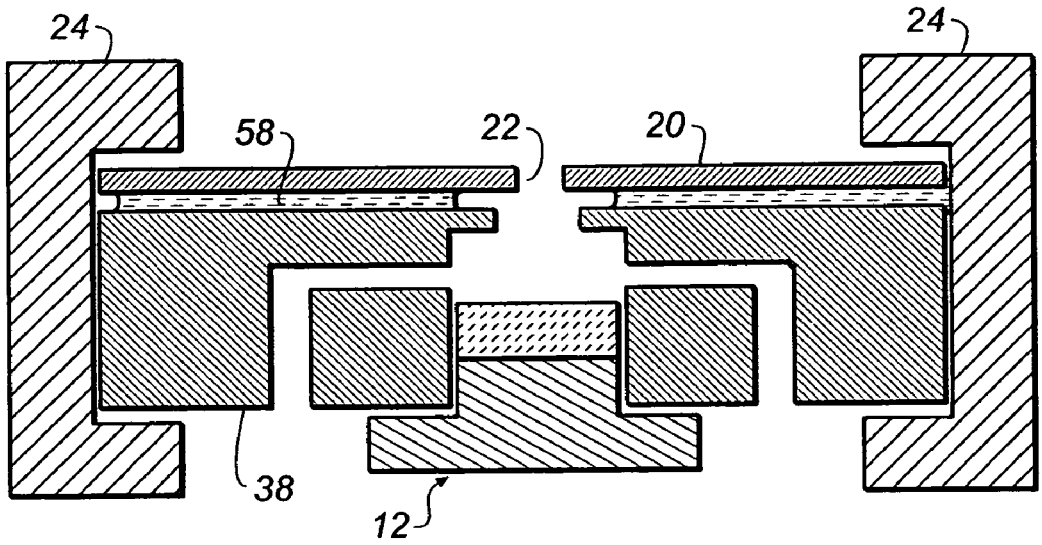
FIG. 13 is a cross-sectional side view showing an ink jet nozzle outfitted with the nozzle plate of the present invention, with a liquid film providing attractive force to retain the nozzle plate against the printhead body.

Yet another method for retaining removable nozzle plate 20 on body 38 is shown in FIG. 13. Here, a liquid film 58 is used to retain removable nozzle plate 20, rather than a bonding agent. For example, films of water or oil can be employed as well as highly viscous films such as greases. The adhesive energy of these liquid films 58 to body 38 and nozzle plate 20 is advantageously chosen to be high in these cases.

Embodiments using Heat-Conductive Elements for Droplet Formation

Figure 14:
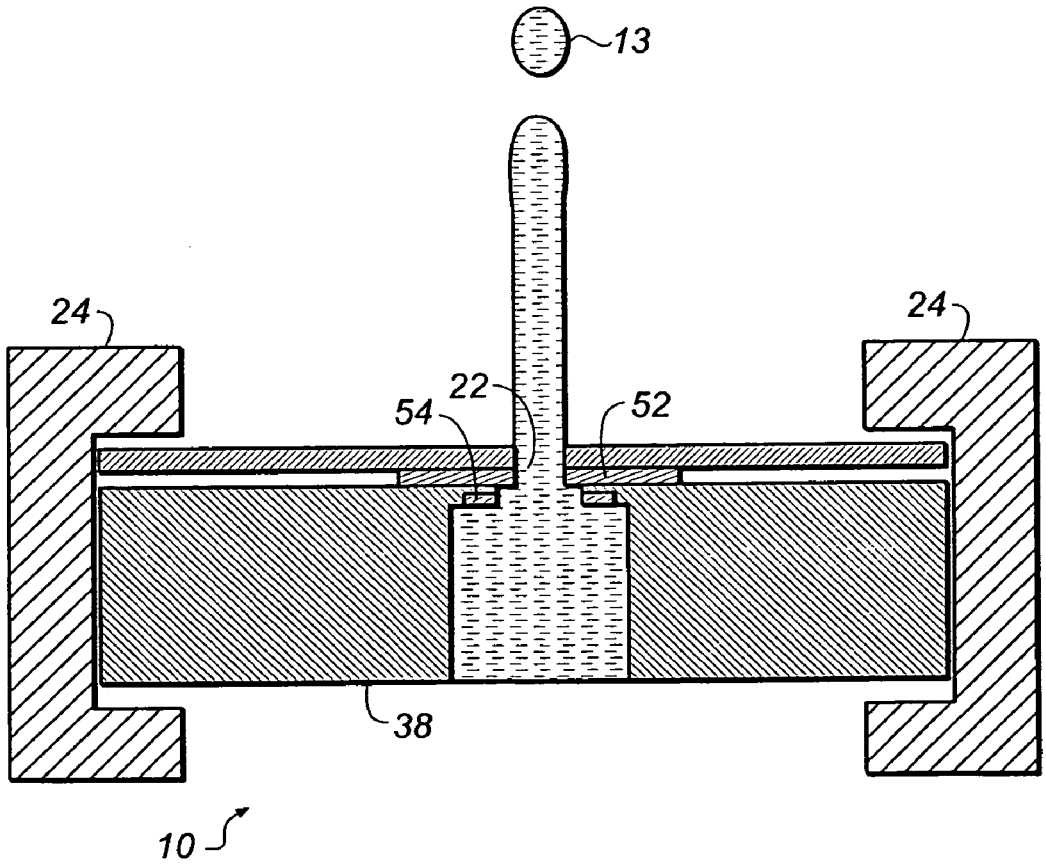
FIG. 14 is a cross-sectional side view showing an ink jet nozzle outfitted with the nozzle plate of the present invention, with an additional heat-conductive element for improved energy delivery.

Adding removable nozzle plate 20 over nozzle orifice 14 may cause subtle changes in fluid droplet 13 formation where a heating mechanism is used, particularly in the continuous type ejector shown in FIG. 5*a*. Referring to FIG. 14, there is shown yet another embodiment of the present invention in which heater element 54 provides fluid droplet 13 formation. An additional heat-conductive element 52 is also provided in order to transport heat generated from heater element 54 more effectively to plate orifice 22.

Figure 15A:
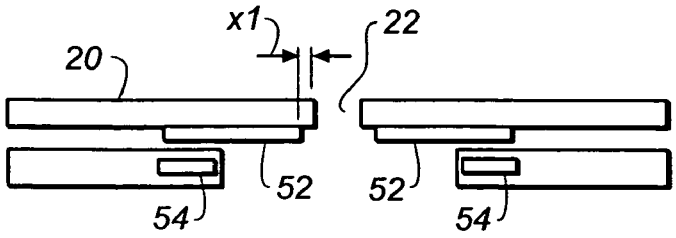
FIGS. 15*a* and 15*b* are side and top views respectively of an arrangement of an ink jet nozzle using an additional heat-conductive element.
Figure 15B:
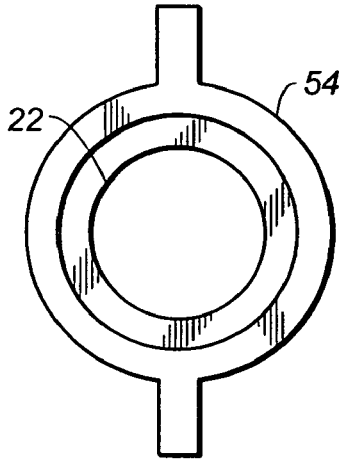

As is shown in FIG. 15*a*, heat-conductive element 52 can be spaced back, by some distance x1, from the perimeter of plate orifice 22, where each fluid droplet 13 is formed. Distance x1 is preferably within at least about 2 microns from the perimeter of nozzle orifice 22 in a preferred embodiment. As is shown in the top view of this embodiment of FIG. 15*b*, heater element 54 is itself spaced back from the perimeter of plate orifice 22. In one embodiment, the inner diameter of heater element 54 is sized and positioned so that the distance from the center of plate orifice 22 to the inner edge of heater element 54 is no more than about 200 microns.

By adding heat-conductive element 52 against or attached to removable nozzle plate 20, droplet-forming heat energy is transferred more closely to the plate orifice 22. Thus, the arrangement of FIGS. 14 and 15*a* stabilize the response of ejector 10 and provide an even distribution of heat around plate orifice 22. Heat-conductive element 52 is shown against the lower surface of removable nozzle plate 20 in the embodiment of FIG. 14. However, other arrangements are possible, including forming heat-conductive element 52 as an integral part of removable nozzle plate 20 or applying heat-conductive element 52 to the top surface of removable nozzle plate 20. Heat-conductive element 52 could be any of a number of suitable materials, including copper, for example.

Figure 16:
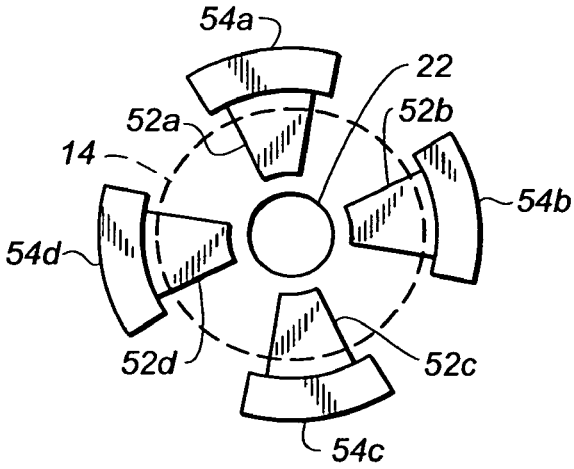
FIG. 16 is a top view showing an arrangement of heater elements and electrical contacts for an alternate embodiment of the nozzle plate of the present invention.

Referring to the top view of FIG. 16, there is shown an alternate embodiment in which heat energy is provided by a plurality of independent segmented heater elements 54*a*, 54*b*, 54*c*, and 54*d*, each of which is capable of independently providing heat to a corresponding heat-conductive element 52*a*, 52*b*, 52*c*, and 52*d*. Thus, by adding heat-conductive elements 52*a*-52*d* against or attached to removable nozzle plate 20, droplet-forming heat energy from a plurality of heater elements is transferred more closely to plate orifice 22. In this way, the trajectory of ejected fluid droplets 13 can be controlled to some extent by providing heat asymmetrically to the ejecting orifice, as disclosed, for example, in U.S. Pat. No. 6,254,225.

Figure 17A:
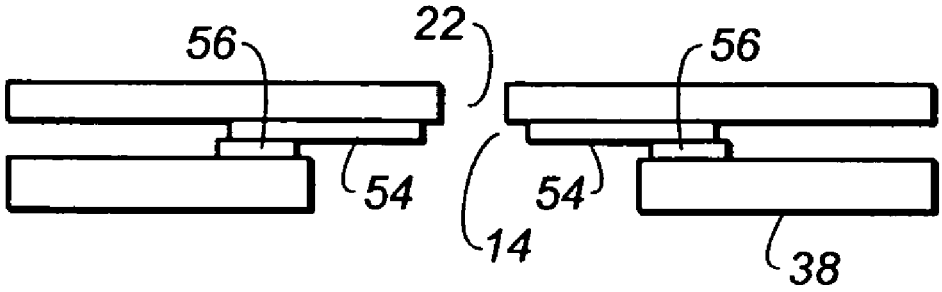
FIGS. 17*a* and 17*b* are side and top views respectively of an alternate arrangement of heater elements and electrical contacts for an alternate embodiment of the nozzle plate of the present invention.
Figure 17B:
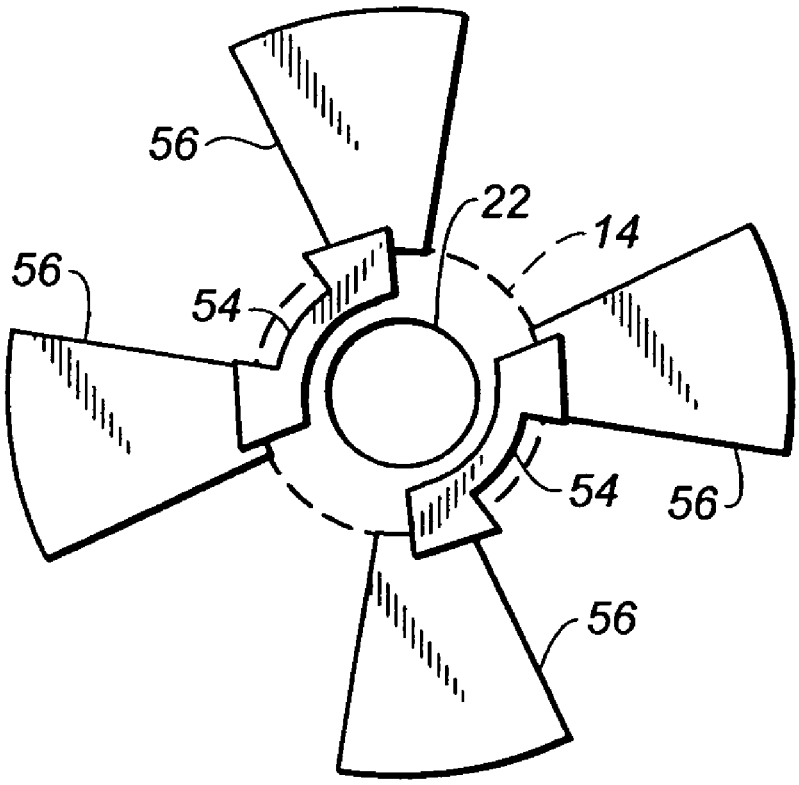

In yet another embodiment, one or more heater elements 54 may be an integral part of removable nozzle plate 20. As is shown in the side and top views of FIGS. 17*a* and 17*b*, respectively, electrical contacts 56 are provided on body 38 for conducting current through heater elements 54 that are part of removable nozzle plate 20, in order that heat be generated near to plate orifice 22. Also in the case of more than one heater element 54, the trajectory direction of ejected fluid droplets 13 can be controlled to some extent by providing heat asymmetrically to the ejecting orifice, as disclosed, for example, in U.S. Pat. No. 6,079,821.

Figure 18A:
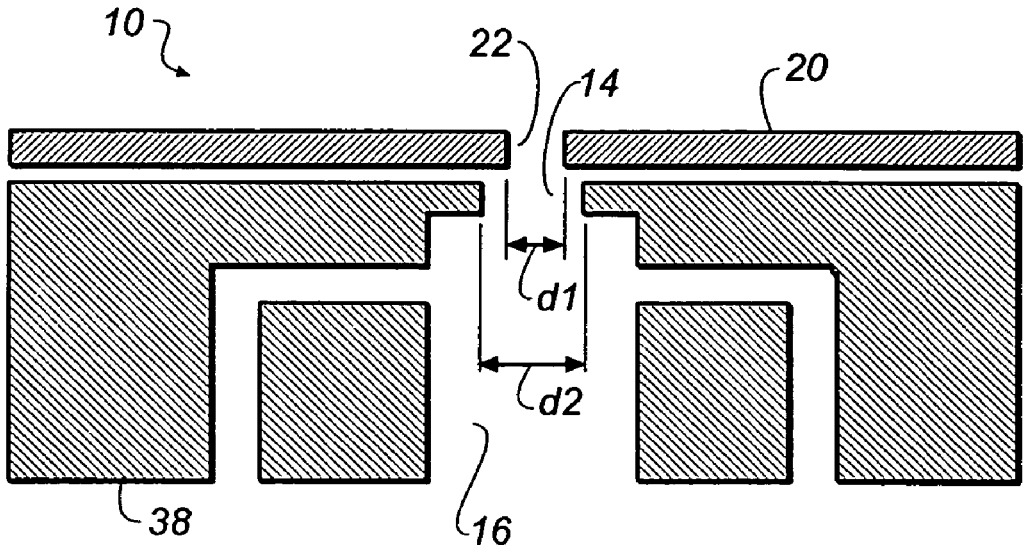
FIGS. 18*a* and 18*b* are cross-sectional side views showing an ink jet nozzle outfitted with the nozzle plate of the present invention, showing specific dimensions of interest for implementing the method of the present invention; and, FIGS. 19*a*, 19*b*, and 19*c* are cross-sectional side views of an ink jet nozzle according to the present invention, showing the basic sequence for removal, cleaning, and reassembly of a printhead.
Figure 18B:
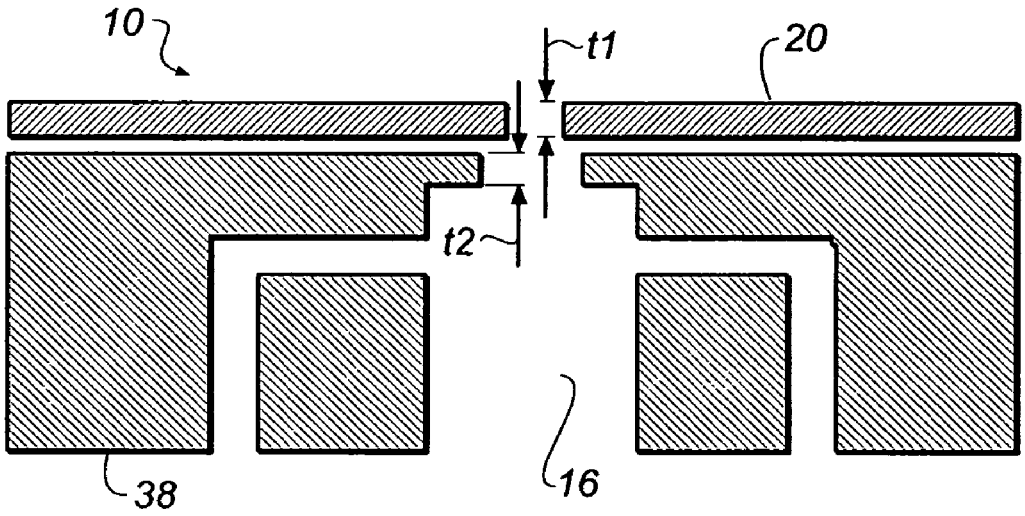

Referring to dimensions as labeled in FIG. 18*a*, diameter dimension d1 of plate orifice 22 can be different from diameter dimension d2 of nozzle orifice 14. Plate orifice 22 can be centered over nozzle orifice 14 or offset from this center position. As is shown in FIG. 18*b*, thickness t1 of removable nozzle plate 20 and t2 of the existing nozzle orifice 14 may be selected to optimize fluid droplet 13 formation characteristics of the printhead. In a preferred embodiment, thickness t1 is also related to diameter dimension d2, such that the ratio of thickness t1 to diameter dimension d2 is less than about 0.20.

Cleaning of the Printhead

Figure 19A:
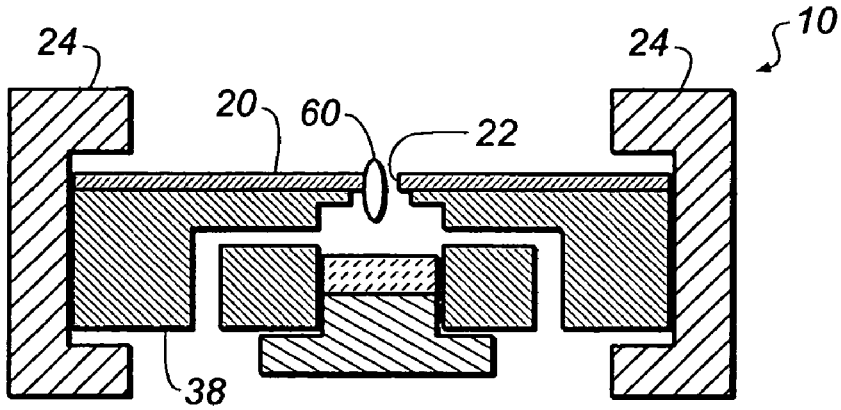
Figure 19B:
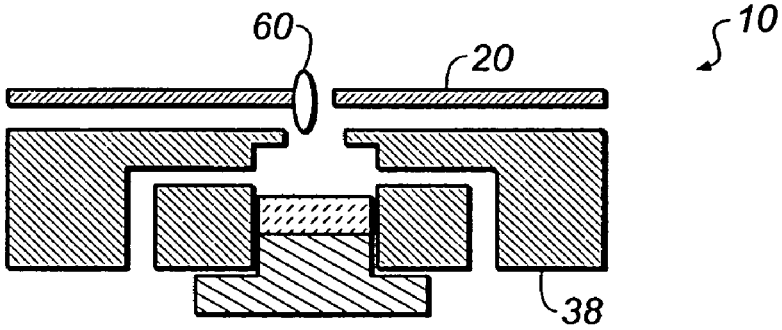
Figure 19C:
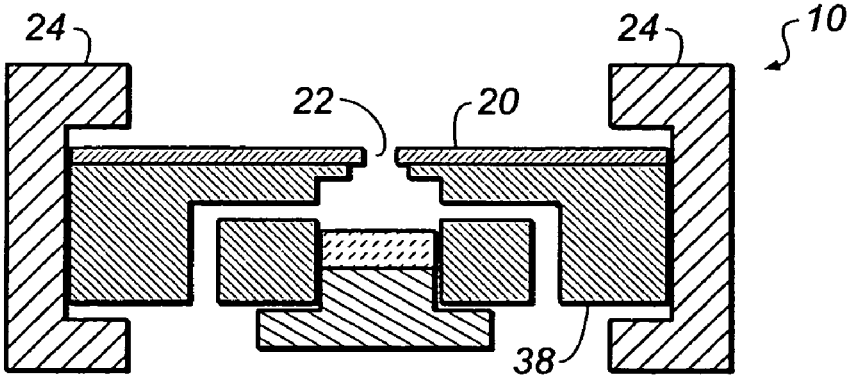

One advantage of the apparatus of the present invention relates to ease of cleaning of the printhead. Referring to FIG. 19*a*, there is shown a side view of ejector 10 with an obstruction 60 blocking plate orifice 22. FIG. 19*b* shows the printhead disassembled, with clamping mechanism 24 removed to free removable nozzle plate 20 from body 38. Removable nozzle plate 20 can be thoroughly cleaned or, if necessary, replaced to eliminate the problem caused by obstruction 60, then reassembled, as is shown in FIG. 19*c*.

Other Alternative Embodiments and Materials

The apparatus and method of the present invention allows for a range of alternative embodiments and the use of a variety of possible materials and configurations for removable nozzle plate 20. As described above, a wide range of clamping mechanisms 24 can be employed. Additionally, examples shown illustrate the use of removable nozzle plate 20 with a continuous flow printhead, or with a drop-on-demand printhead.

Removable nozzle plate 20 can be fabricated from a number of different types of materials, including any of a number of types of plastics, such as mylar, for example. The material used can be solid or a composite, laminated as layers onto a substrate. Various types of coatings can be applied to the surfaces of removable nozzle plate 20 for optimizing ink droplet ejection, such as hydrophobic coatings. Coatings can be applied to allow separation of removable nozzle plate 20 without causing damage. Such coatings can be formulated, for example, from self-assembled monolayers such as FDS or fluorinated siloxanes. Removable nozzle plate 20 can be formed from a number of elastic materials to allow stretching and repositioning of plate orifice 22 as shown in FIGS. 12*a* and 12*b*. Plate orifices 22 can be formed using any of a number of lithographic techniques or other fabrication techniques, as are well known in the art.

The removable nozzle plate 20, described above, helps provide at least one of, simplified cleaning, nozzle refurbishing and replacement, and/or re-sizing of orifice diameters as needed for various ink viscosities and fluid droplet 13 characteristics when compared to current printhead designs. Additionally, the removable nozzle plate 20 allows different arrangements of nozzle orifices without requiring complete printhead redesign. The removable nozzle plate 20 can be adapted to allow the use of different nozzle orifice designs suited to a wide variety of liquid types and/or print conditions. As such, the printhead described herein is not limited to the field of inkjet printing.

The invention has been described in detail with particular reference to certain preferred embodiments thereof, but it will be understood that variations and modifications can be effected within the scope of the invention.

PARTS LIST

10. Ejector
12. Drop-forming mechanism
13. Droplet
14. Nozzle orifice
15. Fluid
16. Fluid chamber
17. Arrows
18. Substrate
19. Nozzle plate
20. Removable nozzle plate
22, 22'. Plate orifice
24. Clamping mechanism
26. Sheet clamp
28. Wire clamp
30. Flexible portion
32. Electrostatic clamping mechanism
34. Vacuum
36. Force-adjustable clamping mechanism
38. Body
40. Printhead
44. Bubble
46. Metallized plate
48. Piezoelectric crystal
50. Piezoelectric mount
52, 52*a*, 52*b*, 52*c*, 52*d*. Heat-conductive element
54, 54*a*, 54*b*, 54*c*, 54*d*. Heater element
56. Contacts
58. Liquid film
60. Obstruction
62. Fasteners
64. Opening
66. Passage
A, B. Positions
d1, d2. Diameter dimension
f, f1, f2. Retaining force
P. Pressure
t1, t2. Thickness
V1. Voltage
x1. Distance

What is claimed is:

1. A printhead comprising:

a body, portions of the body defining a fluid chamber and a nozzle orifice, the nozzle orifice being in fluid communication with the fluid chamber;

a drop forming mechanism operatively associated with the nozzle orifice of the body; and a plate removably positioned over the body, the plate having at least one orifice, the at least one orifice being in fluid communication with the nozzle orifice of the body; and wherein the nozzle orifice of the body has a diameter, the at least one orifice of the plate has a diameter, and the diameter of the at least one orifice of the plate is less than the diameter of the nozzle orifice of the body.

2. The printhead according to claim 1, the nozzle orifice of the body having a diameter, wherein the at least one orifice of the plate includes a plurality of orifices, each having an individual diameter, the individual diameters of the plurality of orifices of the plate being less than the diameter of the nozzle orifice of the body.

3. A printhead comprising:

a body, portions of the body defining a fluid chamber and a nozzle orifice, the nozzle orifice being in fluid communication with the fluid chamber;

a drop forming mechanism operatively associated with the nozzle orifice of the body; and a plate removably positioned over the body, the plate having at least one orifice, the at least one orifice being in fluid communication with the nozzle orifice of the body; and wherein the body has a surface facing the plate, the plate has a surface facing the body, and the surfaces are in contact with each other.

4. The printhead according to claim 3, wherein the surfaces are maintained in contact with each other with an external clamping mechanism.

5. The printhead according to claim 4, wherein the external clamping mechanism is a sheet clamp.

6. The printhead according to claim 4, wherein the external clamping mechanism is a wire clamp.

7. The printhead according to claim 4, the plate including a flexible portion, wherein the external clamping mechanism includes the flexible portion of the plate positioned around the body.

8. The printhead according to claim 4, wherein the external clamping mechanism is an electrostatic clamping mechanism.

9. The printhead according to claim 4, wherein the external clamping mechanism is a magnetic clamping mechanism.

10. The printhead according to claim 9, wherein the external clamping mechanism includes an electromagnet.

11. The printhead according to claim 4, wherein the external clamping mechanism includes a vacuum.

12. The printhead according to claim 4, wherein each surface is chemically treated so as to allow surfaces to separate when the clamping mechanism is removed.

13. The printhead according to claim 12, wherein the chemical treatment renders each surface hydrophobic.

14. The printhead according to claim 3, wherein the positions of the surfaces of the plate and the body are maintained relative to each other with a liquid.

15. The printhead according to claim 3, wherein the positions of the surfaces of the plate and the body are maintained relative to each other with a material having a melting point less than 100° C.

16. The printhead according to claim 3, wherein the surfaces are maintained in contact with each other with a force adjustable clamping mechanism such that the at least one orifice is positionable relative to the nozzle orifice of the body.

17. The printhead according to claim 3, wherein the plate is elastic such that the at least one orifice of the plate is positionable within the nozzle orifice of the body.

18. The printhead according to claim 3, wherein the plate is elastic.

19. The printhead according to claim 3 wherein the shape of the at least one orifice of the plate is substantially round.

20. The printhead according to claim 3 wherein the shape of the at least one orifice of the plate is other than round.

21. The printhead according to claim 3, the plate having a thickness, the at least one nozzle orifice of the plate having a diameter, wherein a ratio of the thickness of the plate to the diameter of the at least nozzle orifice of the plate is less than 0.20.

22. The printhead according to claim 3, the body having a thickness, the at least one nozzle orifice of the plate having a diameter, wherein a ratio of the thickness of the body to the diameter of the at least one nozzle orifice of the plate is less than 0.20.

23. The printhead according to claim 3, wherein the drop forming mechanism includes a piezoelectric actuator.

24. A printhead comprising:

a body, portions of the body defining a fluid chamber and a nozzle orifice, the nozzle orifice being in fluid communication with the fluid chamber;

a drop forming mechanism operatively associated with the nozzle orifice of the body; and a plate removably positioned over the body, the plate having at least one orifice, the at least one orifice being in fluid communication with the nozzle orifice of the body; and wherein the body has a surface facing the plate, the plate has a surface facing the body, and the positions of the surfaces of the plate and the body are maintained relative to each other with a material which can be removed from the body with a peeling force less than 100 grams/square centimeter.

25. A printhead comprising:

a body, portions of the body defining a fluid chamber and a nozzle orifice, the nozzle orifice being in fluid communication with the fluid chamber;

a drop forming mechanism operatively associated with the nozzle orifice of the body;

a plate removably positioned over the body, the plate having at least one orifice, the at least one orifice being in fluid communication with the nozzle orifice of the body; and a heat conducting element positioned between the body and the plate to separate the body and the plate.

26. The printhead according to claim 25, wherein the heat conducting element is a ring surrounding the at least one orifice of the plate.

27. The printhead according to claim 25 wherein the drop forming mechanism includes at least one electrical contact.

28. The printhead according to claim 27, wherein the at least one electrical contact is positioned on a surface of the body facing the plate.

29. The printhead according to claim 28, further comprising a heater positioned between the body and the plate, the heater being electrically connected to the at least one electrical contact.

30. A printhead comprising:

a body, portions of the body defining a fluid chamber and a nozzle orifice, the nozzle orifice being in fluid communication with the fluid chamber;

a drop forming mechanism operatively associated with the nozzle orifice of the body and including a heater; and a plate removably positioned over the body, the plate having at least one orifice, the at least one orifice being in fluid communication with the nozzle orifice of the body; and a heat conducting element positioned between the body and the plate and being operatively associated with the heater; and wherein the at least one orifice of the plate has an edge, the heat conducting element is a heat conducting ring surrounding the at least one orifice of the plate and has an inner edge, and the inner edge of the heat conducting ring is no more than 2 microns from the edge of the at least one orifice of the plate.

31. The printhead according to claim 30, further comprising a heat conducting element positioned on the plate, the heat conducting element being operatively associated with the heater.

32. The printhead according to claim 30, wherein the heater includes a plurality of individually actuatable sections.

33. The printhead according to claim 32, further comprising a heat conducting element positioned between the body and the plate, the heat conducting element including individually actuatable sections operatively associated with individually actuatable sections of the heater.

34. A printhead comprising:

a body, portions of the body defining a fluid chamber;

a drop forming mechanism operatively associated with the fluid chamber; and a removable plate having a first position over the body and a second position removed from the body, the elate having at least one plate orifice, the at least one plate orifice being in fluid communication with the fluid chamber of the body when the plate is located in the first position over the body; and wherein portions of the body define a nozzle orifice in fluid communication with the fluid chamber, the nozzle orifice is located between the fluid chamber and the removable plate when the removable plate is in the first position over the body, and the printhead is operable to produce a fluid drop when the removable plate is located in the second position removed from the body and is operable to produce a fluid drop when the removable plate is in the first position over the body.

35. The printhead according to claim 34, wherein the fluid drop produced when the removable plate is in the second position removed from the body has a first volume and the fluid drop produced when the removable plate is in the first position over the body has a second volume.

36. The printhead according to claim 34, wherein the printhead is a drop on demand type printhead.

37. The printhead according to claim 34, wherein the printhead is a continuous type printhead.

38. The printhead according to claim 34, the body including an array of fluid chambers, the removable plate including an array of the at least one plate orifices, wherein individual orifices of the array of the at least one orifices vary in size.

39. The printhead according to claim 34, the body including an array of fluid chambers, the removable plate including a two dimensional array of the at least one plate orifices.

40. The printhead according to claim 39, wherein orifices of the two dimensional array are positioned on the plate such that redundant pairs of orifices are formed.

41. The printhead according to claim 34, wherein a ratio of fluid chambers to at least one plate orifices is 1 to 1.

42. The printhead according to claim 34, wherein a ratio of fluid chambers to at least one plate orifices is something other than 1 to 1.

43. A printhead comprising:

a body, portions of the body defining a fluid chamber and a nozzle orifice, the nozzle orifice being in fluid communication with the fluid chamber;

a drop forming mechanism operatively associated with the nozzle orifice of the body;

a plate removably positioned over the body, the plate having at least one orifice, the at least one orifice being in fluid communication with the nozzle orifice of the body, wherein the drop forming mechanism includes a heater, the heater including a plurality of individually actuatable section; and a heat conducting element positioned between the body and the plate, the heat conducting element including individually actuatable sections operatively associated with individually actuatable sections of the heater.

44. A printhead comprising:

a body, portions of the body defining a fluid chamber, portions of the body defining a nozzle orifice, the nozzle orifice being in fluid communication with the fluid chamber;

a drop forming mechanism operatively associated with the fluid chamber; and a removable plate having a first position over the body and a second position removed from the body, the plate having at least one plate orifice, the at least one plate orifice being in fluid communication with the fluid chamber of the body when the plate is located in the first position over the body, wherein the nozzle orifice is located between the fluid chamber and the removable plate when the removable plate is in the first position over the body; and wherein the printhead is operable to produce a fluid drop having a first volume when the removable plate is located in the second position removed from the body and is operable to produce a fluid drop having a second volume when the removable plate is located in the first position over the body.

* * * * *